US007867074B2

(12) United States Patent
Gerrard et al.

(10) Patent No.: US 7,867,074 B2
(45) **Date of Patent: *Jan. 11, 2011**

(54) GAMING DEVICE HAVING A BONUS SCHEME WITH MULTIPLE POTENTIAL AWARD SETS

(75) Inventors: Peter Gerrard, Prestwich Manchester (GB); Dov L. Randall, Whitefield Manchester (GB); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 869 days.

This patent is subject to a terminal disclaimer.

(21) Appl. No.: 10/652,457

(22) Filed: Aug. 28, 2003

(65) Prior Publication Data

US 2005/0033461 A1 Feb. 10, 2005

Related U.S. Application Data

(63) Continuation-in-part of application No. 09/822,697, filed on Mar. 30, 2001, now Pat. No. 6,796,899.

(51) Int. Cl.
*A63F 9/24* (2006.01)

(52) U.S. Cl. ..... 463/16; 463/17; 463/18; 463/19; 463/42

(58) Field of Classification Search ..... 463/16–19, 463/40, 42

See application file for complete search history.

(56) References Cited

U.S. PATENT DOCUMENTS

| | | | |
|---|---|---|---|
| 3,191,937 | A | 6/1965 | Kropinski |
| 3,386,739 | A | 6/1968 | Lino |
| 3,506,267 | A | 4/1970 | Taillie |
| 4,448,419 | A | 5/1984 | Telnaes |
| 4,560,161 | A | 12/1985 | Hamano |
| 4,618,150 | A | 10/1986 | Kimura |
| 4,695,053 | A | 9/1987 | Vazquez, Jr. et al. |
| 4,775,155 | A | 10/1988 | Lees |
| 5,205,555 | A | 4/1993 | Hamano |
| 5,342,047 | A | 8/1994 | Heidel et al. |
| 5,344,145 | A | 9/1994 | Chadwick et al. |

(Continued)

FOREIGN PATENT DOCUMENTS

EP 0874337 A1 10/1998

(Continued)

OTHER PUBLICATIONS

Klondike (solitaire). Wikipedia.com. Accessed Sep. 18, 2009. http://en.wikipedia.org/w/index.php?title=Klondike_%28solitaire%29&direction=prev&oldid=1400382.*

(Continued)

*Primary Examiner*—Dmitry Suhol
*Assistant Examiner*—Andrew Kim
(74) *Attorney, Agent, or Firm*—K&L Gates LLP

(57) ABSTRACT

A gaming device and a method for operating the gaming device including several groups displayed by a display device and at least one component associated with each group. Several selections are displayed by the display device having multiple components of the groups associated with the selections. A player completes a group and receives a prize for that group when the player picks selections and generates each component associated with a group.

86 Claims, 23 Drawing Sheets

U.S. PATENT DOCUMENTS 5,393,057 A 2/1995 Marnell, II
5,393,061 A 2/1995 Manship et al.
5,411,271 A 5/1995 Mirando
5,449,173 A 9/1995 Thomas et al.
5,456,465 A 10/1995 Durham
5,536,016 A 7/1996 Thompson
5,577,727 A 11/1996 Brame et al.
5,611,535 A 3/1997 Tiberio
5,611,730 A 3/1997 Weiss
5,639,089 A 6/1997 Matsumoto et al.
5,641,730 A 6/1997 Brown
5,645,486 A 7/1997 Nagao et al.
5,722,891 A 3/1998 Inoue
5,752,881 A 5/1998 Inoue
5,755,619 A 5/1998 Matsumoto et al.
5,769,716 A 6/1998 Saffari et al.
5,772,509 A 6/1998 Weiss
5,788,573 A 8/1998 Baerlocher et al.
5,823,874 A 10/1998 Adams
5,833,537 A 11/1998 Barrie
5,848,932 A * 12/1998 Adams ..... 463/20
5,851,148 A 12/1998 Brune et al.
5,882,261 A 3/1999 Adams
5,890,962 A 4/1999 Takemoto
5,902,184 A 5/1999 Bennett
5,911,418 A 6/1999 Adams
5,927,714 A 7/1999 Kaplan
5,934,998 A 8/1999 Forte et al.
5,935,002 A 8/1999 Falciglia
5,938,200 A 8/1999 Markowicz et al.
5,947,820 A 9/1999 Morro et al.
5,951,397 A 9/1999 Dickinson
5,976,015 A 11/1999 Seelig et al.
5,980,384 A 11/1999 Barrie
5,997,400 A 12/1999 Seelig et al.
5,997,401 A 12/1999 Crawford
6,004,207 A 12/1999 Wilson, Jr. et al.
6,015,346 A 1/2000 Bennett
6,019,369 A 2/2000 Nakagawa et al.
6,033,307 A 3/2000 Vancura
6,056,642 A 5/2000 Bennett
6,059,289 A 5/2000 Vancura
6,059,658 A 5/2000 Mngano et al.
6,062,980 A 5/2000 Luciano
6,089,976 A * 7/2000 Schneider et al. ..... 463/16
6,089,978 A 7/2000 Adams
6,093,102 A 7/2000 Bennett
6,095,921 A 8/2000 Walker et al.
6,102,798 A 8/2000 Bennett
6,117,009 A * 9/2000 Yoseloff ..... 463/20
6,120,377 A 9/2000 McGinnis et al.
6,126,542 A 10/2000 Fier
6,135,884 A 10/2000 Hedrick et al.
6,142,873 A 11/2000 Weiss et al.
6,159,097 A 12/2000 Gura
6,159,098 A 12/2000 Slomiany et al.
6,162,121 A 12/2000 Morro et al.
6,165,071 A 12/2000 Weiss
6,168,520 B1 1/2001 Baerlocher et al.
6,168,523 B1 1/2001 Piechowiak et al.
6,173,955 B1 1/2001 Perrie et al.
6,174,235 B1 1/2001 Walker et al.
6,186,894 B1 2/2001 Mayeroff
6,190,254 B1 2/2001 Bennett
6,190,255 B1 2/2001 Thomas et al.
6,203,429 B1 3/2001 Demar et al.
6,224,482 B1 5/2001 Bennett
6,224,483 B1 5/2001 Mayeroff
6,227,971 B1 5/2001 Weiss
6,231,442 B1 5/2001 Mayeroff
6,234,897 B1 5/2001 Frohm et al.
6,261,177 B1 7/2001 Bennett
6,270,408 B1 8/2001 Sakamoto et al.
6,270,411 B1 8/2001 Gura et al.
6,270,412 B1 8/2001 Crawford et al.
6,299,165 B1 10/2001 Nagano
6,309,300 B1 10/2001 Glavich
6,315,660 B1 11/2001 DeMar et al.
6,315,663 B1 11/2001 Sakamoto
6,315,664 B1 11/2001 Baerlocher et al.
6,319,123 B1 11/2001 Paludi
6,319,124 B1 11/2001 Baerlocher et al.
6,322,309 B1 11/2001 Thomas et al.
6,334,814 B1 1/2002 Adams
6,336,863 B1 1/2002 Baerlocher et al.
6,346,043 B1 2/2002 Colin et al.
6,347,996 B1 2/2002 Locke et al.
6,364,766 B1 4/2002 Anderson et al.
6,364,767 B1 4/2002 Brossard et al.
6,364,768 B1 4/2002 Acres et al.
6,398,644 B1 6/2002 Perrie et al.
6,428,412 B1 8/2002 Anderson et al.
6,435,511 B1 8/2002 Vancura et al.
6,439,995 B1 8/2002 Hughs-Baird et al.
6,443,837 B1 9/2002 Jaffe et al.
6,450,887 B1 9/2002 Mir et al.
6,461,241 B1 10/2002 Webb et al.
6,464,582 B1 10/2002 Baerlocher et al.
6,508,707 B2 1/2003 DeMar et al.
6,511,375 B1 1/2003 Kaminkow
6,514,141 B1 2/2003 Kaminkow et al.
6,547,242 B1 4/2003 Sugiyama et al.
6,554,283 B2 4/2003 Vancura et al.
6,561,904 B2 5/2003 Locke et al.
6,582,307 B2 6/2003 Webb
6,585,591 B1 7/2003 Baerlocher et al.
6,599,185 B1 7/2003 Kaminkow et al.
6,599,193 B2 7/2003 Baerlocher et al.
6,602,135 B1 8/2003 Gerrard
6,602,137 B2 8/2003 Kaminkow et al.
6,607,437 B2 8/2003 Casey et al.
6,607,438 B2 8/2003 Baerlocher et al.
6,609,971 B2 8/2003 Vancura
6,609,972 B2 8/2003 Seelig et al.
6,609,973 B1 8/2003 Weiss
6,632,140 B2 10/2003 Berman et al.
6,645,071 B2 11/2003 Perrie et al.
6,685,561 B2 2/2004 Anderson et al.
6,719,630 B1 4/2004 Seelig et al.
6,796,899 B2 9/2004 Baerlocher
6,796,900 B2 9/2004 Baerlocher et al.
6,802,775 B2 10/2004 Baerlocher et al.
6,855,052 B2 2/2005 Weiss et al.
6,899,618 B2 5/2005 Colin et al.
6,913,533 B2 7/2005 Cuddy et al.
6,932,701 B2 8/2005 Glavich et al.
7,169,046 B2 1/2007 Webb et al.
7,270,604 B2 9/2007 Gerrard et al.
7,575,514 B2 8/2009 Cuddy et al.
2001/0024971 A1 9/2001 Brossard
2001/0031659 A1 10/2001 Perrie et al.
2002/0052232 A1 5/2002 Kaminkow
2002/0142821 A1 10/2002 Baerlocher
2003/0078089 A1 4/2003 Gray et al.
2004/0002372 A1 1/2004 Rodgers et al.
2004/0204229 A1 10/2004 Walker et al.

FOREIGN PATENT DOCUMENTS

EP 0945837 A2 9/1999
EP 0984408 A2 3/2000
EP 0984409 A2 3/2000
GB 2353128 2/2001
WO WO 00/12186 3/2000

WO WO 02/078804 10/2002

OTHER PUBLICATIONS

Addams Family Advertisement and Article, written by IGT, published 2000.
Austin Powers Brochure, written by IGT, published 2001.
Jackpot Party Brochures and Articles, written by WMS Gaming, Inc., published 1998.
Jumble Article, written by Strictly Slots, published 2000.
Polly & Ranger Brochure, written by Anchor Games, published 2000.
Price Is Right Showcase Showdown Description, schuminweb.com (website), printed Mar. 16, 2001.
Sphinx Advertisement, written by Atronic Casino Technology, Ltd., published 2000.
Take Your Pick Advertisement, written by IGT/Anchor Gaming, published 1999.
Take Your Pick Article, written by Strictly Slots, published 2001.
Top Dollar Advertisement, written by IGT, published 1998.
Top Gear Brochure, written by Aristocrat, published 1995.
A Salute to Game Shows, [Online] Retrieved from the Internet: <URL http://game-shows.chris-place.com/shows/price-is-right/pricing-games.htm. [Downloaded Oct. 25, 2007] (10 pages).
Any Number—The Price is Right, [Online] Retrieved from the Internet: <URL http://www.priceisright.com/page.aspx?pageId=807823. [Downloaded Oct. 25, 2007] (2 pages).
Bonus Spin Advertisement, written by IGT, published prior to 2000.
Double Diamond Run Advertisement, written by IGT, published in 2001.
Fortune Cookie Advertisement, written by IGT, published in 2000.
Little Devil Advertisement, written by IGT, published in 2000.
On the Money Article, written by Strictly Slots, published in 2000.
Price is Right Advertisement, written by IGT, published in 2001.
Psycho Cash Beast Advertisement, written by IGT, published in 1999.
Texas Tea Advertisement, written by IGT, published in 2000.
Wheel of Fortune Advertisement, written by IGT, published in 1997.
Winning Streak Advertisement, written by Aristocrat, published in 1994.

* cited by examiner

FIG.13

120 118 122

| AWARD | PROBABILITY |
|---|---|
| 5 | 5 % |
| 10 | 10 % |
| 15 | 20 % |
| 20 | 20 % |
| 25 | 20 % |
| 30 | 10 % |
| 35 | 10 % |
| 40 | 5 % |
| TOTAL | 100 % |

FIG.14

128 124 126

| SET | PROBABILITY |
|---|---|
| A | 40.00% |
| B | 40.00% |
| A&B | 20.00% |
| | 100.00% |

FIG. 22

402 Possible Combinations in a Three-Selection Game Example 404

| Combination (412) | Selections | | | Component Symbols | | | | | | | |
|---|---|---|---|---|---|---|---|---|---|---|---|
| | | | | A | B | C | D | E | F | G | H |
| 1 | 1 | 2 | 3 | A | B | CCC | DD | EEE | FFF | GG | HHH |
| 2 | 1 | 2 | 4 | | B | CC | DDD | EEE | FF | GGG | HH |
| 3 | 1 | 2 | 5 | A | BBB | CCC | DD | EEE | F | GGG | HHH |
| 4 | 1 | 2 | 6 | A | B | CC | DD | EEE | FF | GGG | HHH |
| 5 | 1 | 3 | 4 | A | B | CC | DDD | EE | FFF | GG | H |
| 6 | 1 | 3 | 5 | AA | BBB | CCC | D | EEE | FFF | G | HH |
| 7 | 1 | 3 | 6 | AA | B | CC | D | EE | FFF | G | HHH |
| 8 | 1 | 4 | 5 | A | BBB | CC | DDD | EE | FF | GGG | H |
| 9 | 1 | 4 | 6 | A | B | C | DDD | E | FFF | GGG | HH |
| 10 | 1 | 5 | 6 | AA | BBB | CC | D | EE | FF | GG | HHH |
| 11 | 2 | 3 | 4 | A | | CC | DDD | EEE | FFF | GGG | HHH |
| 12 | 2 | 3 | 5 | AA | BB | CCC | D | EEE | FF | GGG | HHH |
| 13 | 2 | 3 | 6 | AA | | CC | D | EEE | FFF | GGG | HHH |
| 14 | 2 | 4 | 5 | A | BB | CC | DDD | EEE | F | GGG | HHH |
| 15 | 2 | 4 | 6 | A | | C | DDD | EE | FF | GGG | HHH |
| 16 | 2 | 5 | 6 | AA | BB | CC | D | EEE | F | GGG | HHH |
| 17 | 3 | 4 | 5 | AA | BB | CC | DD | EE | FFF | GGG | HH |
| 18 | 3 | 4 | 6 | AA | | C | DD | E | FFF | GGG | HHH |
| 19 | 3 | 5 | 6 | AAA | BB | CC | D | EE | FFF | GG | HHH |
| 20 | 4 | 5 | 6 | AA | BB | C | DD | E | FF | GGG | HHH |
| 416 Number of Wins | | | | 1 | 4 | 4 | 7 | 10 | 10 | 14 | 14 (416h) |
| 414 Probability of Win | | | | 5% (416a, 414a) | 20% | 20% | 35% | 50% | 50% | 70% | 70% (414h) |

FIG. 23

Comparison of a Three-Selection Game Example with a First-to Fill Game Example 402 404

| | All Three Selections | | | Component Symbols | | | | | | | | | |
|---|---|---|---|---|---|---|---|---|---|---|---|---|---|
| | | | | A | B | C | D | E | F | G | H | Total | |
| Three-Selection Game | 1 | 2 | 3 | A | B | CCC | DD | EEE | FFF | GG | HHH | 385 | 420 |
| First-to Fill Game | Order of Selections | | | A | B | C | D | E | F | G | H | Total | |
| | 1 | 2 | 3 | | B | CC | DD | EEE | F | GG | HH | 75 | 422 |
| | 1 | 3 | 2 | A | B | CC | D | EE | FFF | | H | 50 | 424 |
| | 2 | 1 | 3 | | B | CC | DD | EEE | F | GG | HH | 75 | |
| | 2 | 3 | 1 | A | | CC | D | EEE | FF | GG | HHH | 85 | |
| | 3 | 1 | 2 | A | B | CC | D | EE | FFF | | H | 50 | |
| | 3 | 2 | 1 | A | | CC | D | EEE | FF | GG | HHH | 85 | |

GAMING DEVICE HAVING A BONUS SCHEME WITH MULTIPLE POTENTIAL AWARD SETS

PRIORITY CLAIM

This application is a continuation-in-part of and claims the benefit of U.S. patent application Ser. No. 09/822,697, filed on Mar. 30, 2001 now U.S. Pat. No. 6,796,899.

CROSS REFERENCE TO RELATED APPLICATIONS

This application is related to the following commonly-owned patent applications: "GAMING DEVICE HAVING A BONUS SCHEME WITH MULTIPLE SELECTION GROUPS," Ser. No. 09/656,702, now U.S. Pat. No. 6,439,995; "GAMING DEVICE WITH BONUS SCHEME PROVIDING INCREASED REWARD FOR SELECTING RELATED SYMBOLS," Ser. No. 09/605,023, now U.S. Pat. No. 6,669,559; "GAMING DEVICE HAVING A MULTIPLE SELECTION GROUP BONUS ROUND," Ser. No. 09/605,107, now U.S. Pat. No. 6,511,375; "GAMING DEVICE HAVING A MULTIPLE SELECTION SET BONUS SCHEME," Ser. No. 09/680,592, now U.S. Pat. No. 6,602,135; "GAMING DEVICE HAVING A BONUS SCHEME INCLUDING A PLURALITY OF SELECTION GROUPS WITH WIN-GROUP OUTCOMES," Ser. No. 09/981,084, now U.S. Pat. No. 6,932,701; "APPARATUS AND METHOD FOR MODIFYING GENERATED VALUES TO DETERMINE AN AWARD IN A GAMING DEVICE," Ser. No. 09/957,018, "GAMING DEVICE HAVING A BONUS SCHEME WITH MULTIPLE POTENTIAL AWARD SETS," Ser. No. 09/822,697, now U.S. Pat. No. 6,796,899; "GAMING DEVICE HAVING A BONUS SCHEME WITH MULTIPLE SELECTION GROUPS," Ser. No. 10/195,292, now U.S. Pat. No. 6,595,854; "GAMING DEVICE HAVING A BONUS SCHEME WITH MULTIPLE SELECTION GROUPS," Ser. No. 10/243,047, now U.S. Pat. No. 7,273,415; "GAMING DEVICE HAVING A MULTIPLE SELECTION GROUP BONUS ROUND," Ser. No. 10/327,538, now U.S. Pat. No. 7,303,469; "GAMING DEVICE HAVING A BONUS SCHEME WITH MULTIPLE SELECTION GROUPS," Ser. No. 10/623,421, now U.S. Pat. No. 7,182,689; "GAMING DEVICE HAVING A MULTIPLE SELECTION SET BONUS SCHEME," Ser. No. 10/607,663, now U.S. Pat. No. 6,863,607; "GAMING DEVICE HAVING A CHANGING MULTIPLE SELECTION SET BONUS SCHEME," Ser. No. 10/458,445, now U.S. Pat. No. 6,817,943; "GAMING DEVICE WITH BONUS SCHEME PROVIDING INCREASED REWARD FOR SELECTING RELATED SYMBOLS," Ser. No. 10/690,305, now U.S. Pat. No. 6,878,061; "GAMING DEVICE HAVING A PLAYER SELECTION GAME," Ser. No. 10/954,132, "GAMING DEVICE HAVING A BONUS SCHEME WITH MULTIPLE POTENTIAL AWARD SETS," Ser. No. 10/949,088, and "GAMING DEVICE HAVING A CHANGING MULTIPLE SELECTION SET BONUS SCHEME," Ser. No. 10/977,672.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a bonus scheme including multiple potential award sets, wherein the player obtains an award associated with one of the award sets.

BACKGROUND OF THE INVENTION

Primary and secondary games in gaming machines generally result in a win or a loss for the player. In a slot machine game, the game ends when the reels stop and the gaming device analyzes the symbol combinations to determine if one or more winning outcomes exist. In a poker game, the game randomly deals cards, the player has one or more opportunities to randomly generate one or more new cards, and the player wins or loses based on a final combination of cards. In a blackjack game, the player's card values add until the player's hand beats the dealer's hand, loses to the dealer's hand, or busts.

In each of these well known games, the game ends after a number of random generations. In slot machines, the basic game ends after one random generation. In poker machines, the game ends after one, two or more random generations, depending on the type of poker game. In blackjack machines, the number of generations varies, but has a limit, namely, until the card denominations add to or exceed twenty one.

Known bonus games employ a plurality of game ending strategies. One known strategy is a do-until strategy in which the player picks until picking a bonus terminator. European Patent Application No. EP 0 945 837 A2 filed on Mar. 18, 1999 and assigned on its face to WMS Gaming, Inc. discloses a bonus game in which a player has one or more opportunities to select masked bonus awards. When the player selects a masked award, the game reveals the selection and provides the award to the player. The player selects until all the selections are selected or until selecting a game terminator. In other games, the player selects from a group of selections until two or more matching selections are picked by the player.

Another known bonus game ending strategy includes letting the player decide whether to end the game with a particular result or trade results with the hope of obtaining a higher award. The TOP DOLLAR® gaming device, which is manufactured and distributed by the assignee of this application, provides the player with three offers and a final award. When an offer is given, the player may accept or reject it. If the player accepts an offer, the player receives the accepted bonus amount and the bonus round terminates. If the player declines an offer, the game generates another offer for the player, which may be a higher or lower award. The game is similar to poker, wherein the player has a limited opportunity to better an outcome.

In each of the foregoing games, the game ends upon a limited number of random generations or upon a result of the random generations. In an effort to create a more entertaining and exciting game, a need exists to create a gaming machine or device having a new apparatus and methods for ending a game and to combine these methods with the known methods described above.

SUMMARY OF THE INVENTION

The present invention provides a gaming device and, in particular, a bonus scheme of a gaming device that enables players to accumulate awards in a plurality of sets until one of the sets is completed. Each set includes at least one and preferably a plurality of components. The gaming device enables a player to pick a plurality of selections from a group of masked selections. Preferably, a component from one of the sets is associated with each selection. A component from two or more sets, or of each of the sets, could also be associated with a selection.

In one embodiment, the components of a set include values, modifiers and bonuses; however, it should be appreciated that other components could be part of, or associated with, a set or a plurality of sets in addition to, or in place of, the values, modifiers and bonuses. At least one and preferably a plurality of designated or predetermined components are necessary to complete a set. For instance, in the preferred embodiment, each set has a plurality of value components. To complete such set, all of the value components in such set must be obtained or selected by the player. It should be appreciated that the number of or type of components in each set necessary to complete the set may vary and that the components necessary to terminate each set is preferably, but does not have to be, identical or similar. For example, a bonus component may be required to complete one of the sets.

Each component preferably has a symbol or other identifier associated with the component, and particularly the value components or the components necessary to complete a set. Thus, when the player picks one of the selections from the group of masked selections (which the game preferably simultaneously displays to the player), the game reveals the value and the identifier or symbol associated with one of the sets (i.e., to identify the component of the appropriate set). In one embodiment of the invention, an identifier or symbol is associated with a selection before a player picks from the group of masked selections. In another embodiment, the player picks the selection and then the symbol or identifier is associated with the selection before revealing the selection to the player. It should also be appreciated that the processor of the gaming device could randomly determine the selections. In accord with one aspect of the invention, the components are weighted such that the processor is more likely to assign one component to a selection over another component.

The player preferably receives the award associated with the first set completed; however, the player could receive an award from another completed set, such as the last set completed, or from an uncompleted set or from multiple sets completed simultaneously. The award provided to the player is preferably based on the components of the appropriate set, such as the first set completed in the preferred embodiment. In one embodiment, the award provided to the player includes the sum of the value components achieved, modified by any modifiers such as a multiplier (if any modifiers are obtained before the first set is completed) and the addition of any bonuses (if any bonuses are obtained before the first set is completed).

As indicated above, another aspect of the invention includes bonuses or bonus credits which are associated with the selections. If a player picks a selection and generates a bonus, the bonus is added to the designated set, a combination of the sets, or to all of the sets.

As also indicated above, in yet another aspect of the invention a modifier, such as a multiplier, is associated with one or more of the selections. If a player picks a selection, which includes a modifier, the modifier changes the value of a set based on the modifier. A modifier may be associated with any designated set, a combination of the sets, or all of the sets.

In an alternative embodiment, the gaming device accumulates components in a plurality of sets or groups until at least one of the groups is completed (i.e., a predetermined number such as all of the components of the group or groups have been accumulated). In one embodiment, the components include symbols or identifiers having no value by itself. The value of each group is defined by an outcome or award associated with that group. In one embodiment, the groups have different associated outcomes.

In one embodiment of this alternative embodiment of the present invention, one or more of the components, identifiers, modifiers or symbols are associated with a selection before the gaming device enables the player to pick from the group of masked selections. When the player picks one of the selections from the group of masked selections, the gaming device reveals the components, identifiers, modifiers or symbols associated with that selection and their groups. In another embodiment, one or more of the components, identifiers, modifiers or symbols are associated with a masked selection picked by the player before revealing the component to the player. It should also be appreciated that the processor of the gaming device could randomly determine the selections. In accord with one aspect of the invention, the components are weighted such that the processor is more likely to assign one component to a selection over another component. The components can also be weighted such that at least one group is more likely to be completed than at least one other group as further discussed below.

In one embodiment, the player receives the outcome associated with the first group completed or the outcome associated with each of a plurality of simultaneously completed groups. Alternatively, the player receives an outcome from another completed group, such as the last group completed or from one or more uncompleted groups. In an alternative embodiment, the outcome provided to the player includes any outcome associated with a completed group of components and is provided to the player upon the selection of a number of selections, such as a randomly or predetermined number of selections. In one embodiment, the outcome associated with a group can be modified by a modifier associated with one or more components of the group.

Although the present invention is discussed relative to a bonus game of a gaming machine, it should be appreciated that the present invention could be employed as a primary game in a gaming device.

It is therefore an advantage of the present invention to provide a gaming device having a plurality of potential award sets and a player obtains an award associated with one of the award sets.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 13 is a schematic diagram illustrating an award distribution table.

FIG. 14 is a schematic diagram illustrating a component distribution table.

FIG. 22 is a table listing the possible combinations of selections available to a player in an example game having three of six selections applying the set component distribution of FIG. 21; and FIG. 23 is a table comparing the awards generated in a three-selection game to those in a first-to-fill game applying the set component distribution of FIG. 21.

DETAILED DESCRIPTION OF THE INVENTION

Gaming Device and Electronics

Figure 1A:
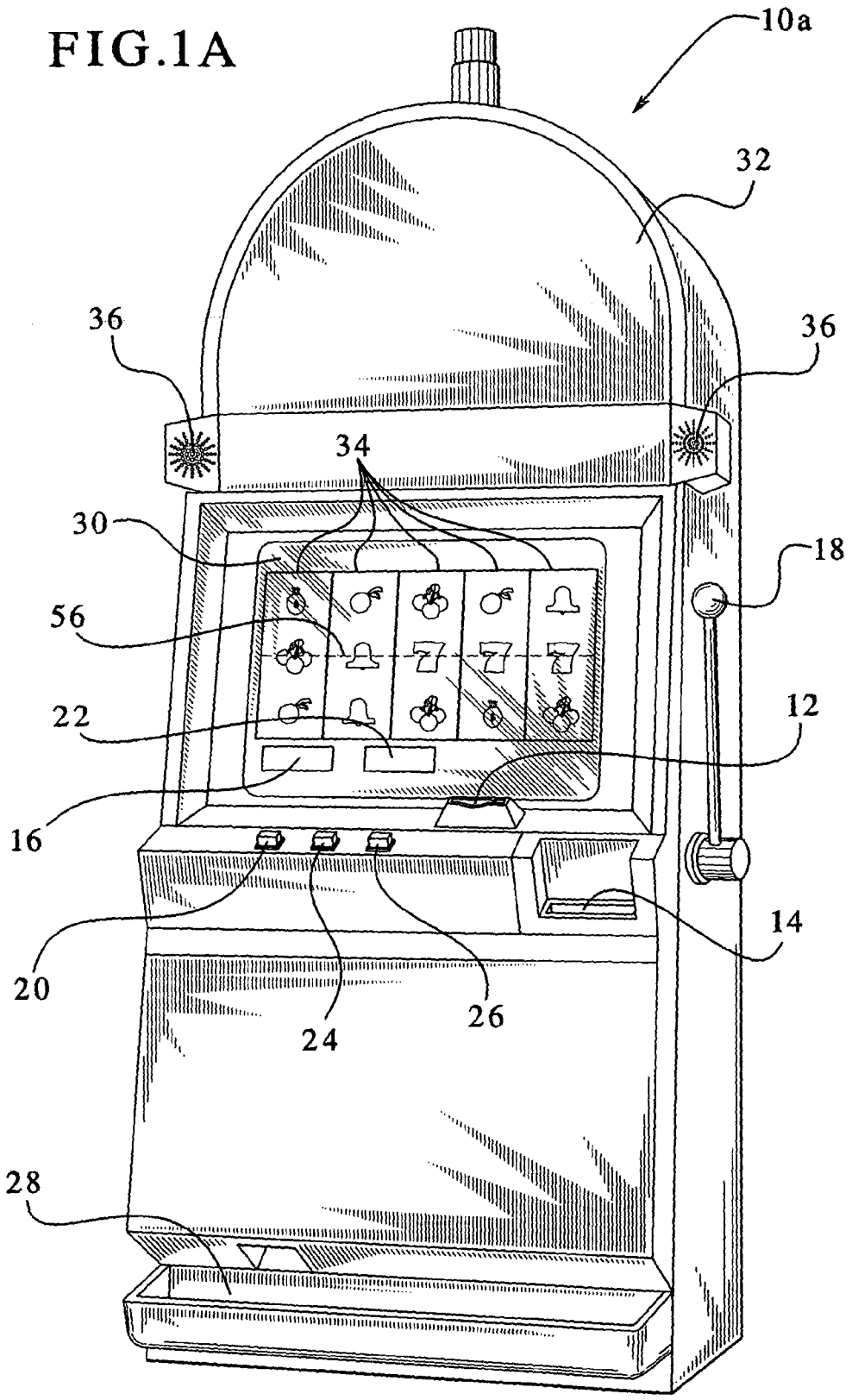
FIG. 1A is a front-side perspective view of one embodiment of the gaming device of the present invention.
Figure 1B:
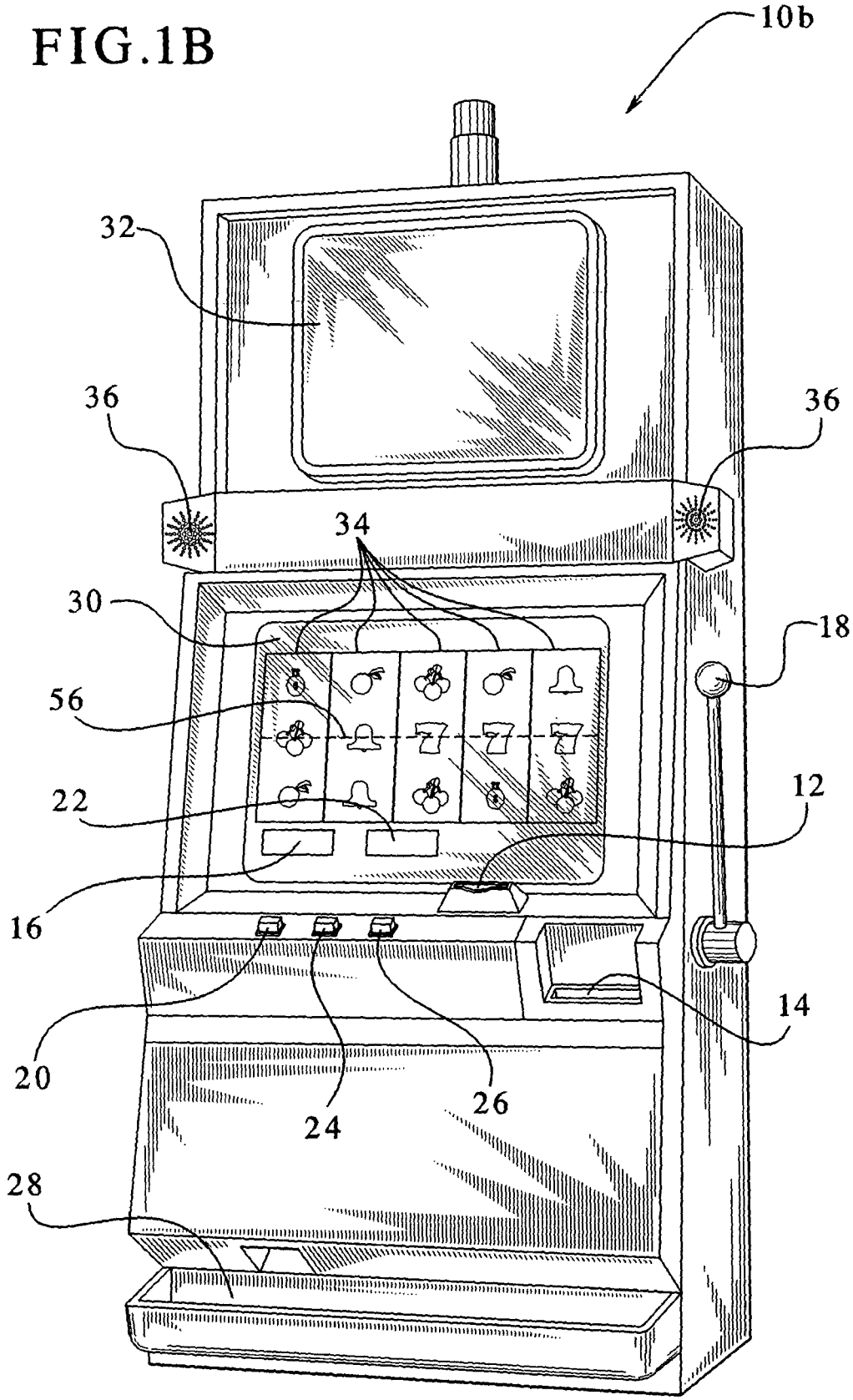
FIG. 1B is a front-side perspective view of another embodiment of the gaming device of the present invention.

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game of the present invention (described below) encompassing a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base, bonus and progressive games include mechanical, electrical or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit cards, debit cards or smart cards. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, and preferably in the slot machine embodiment of the gaming device 10, includes speakers 36 for making sounds or playing music.

Figure 2:
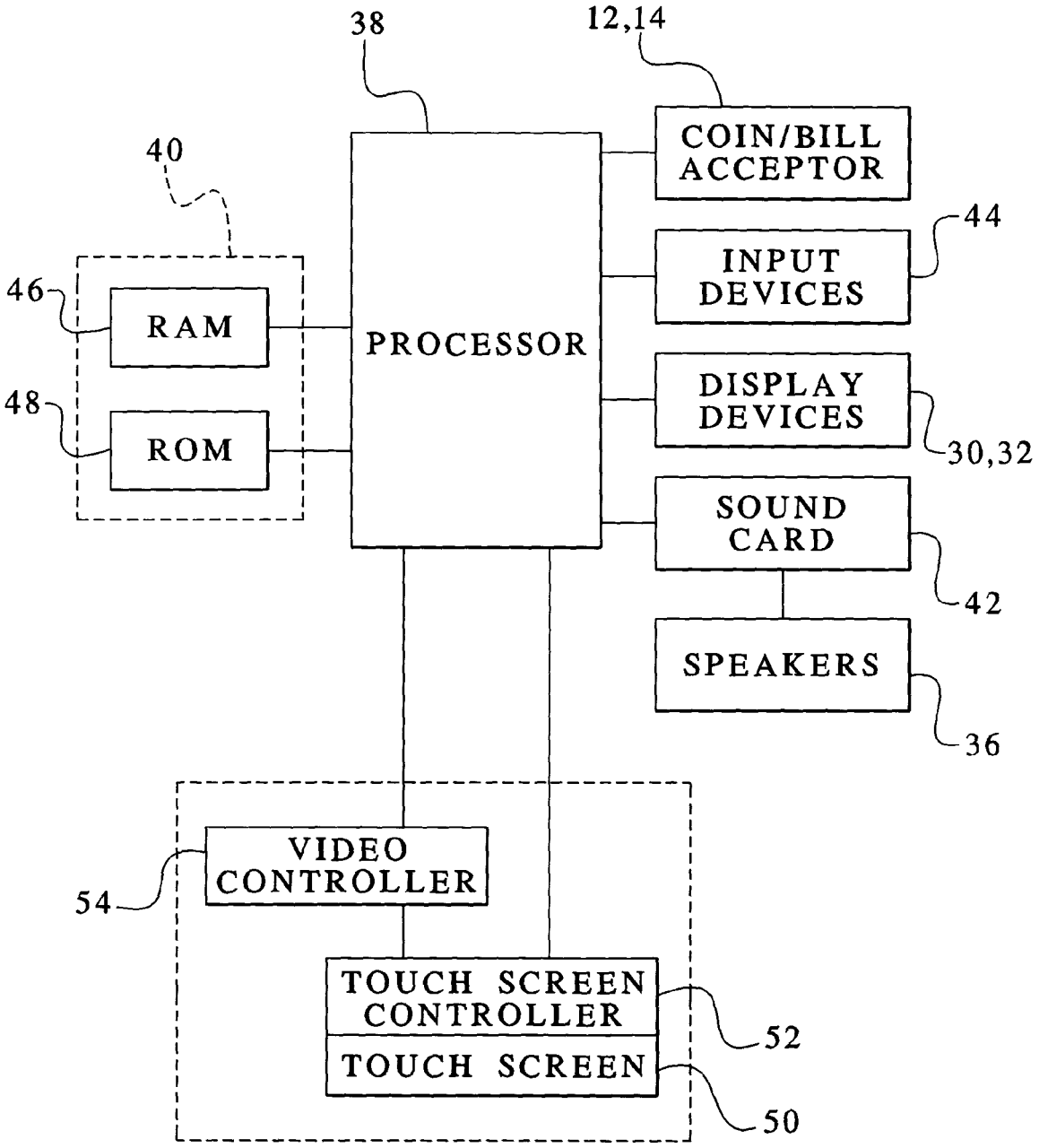
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or the "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. A player can make decisions and input signals into the gaming device 10 by touching touch screen 50 at the appropriate places. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming the device 10, the player inserts the appropriate amount of money or tokens at coin slot 12 or bill acceptor 14 and then pulls the arm 18 or pushes the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. Bonus games include a program that automatically begins when the player achieves a qualifying condition in the base game. The gaming device 10 preferably employs a video-based central display device 30 or 32 for the bonus round.

In the slot machine embodiment, the qualifying condition includes a particular symbol or symbol combination generated on a display device. As illustrated in the five reel slot game shown in FIGS. 1A and 1B, the qualifying condition includes the number seven appearing on three adjacent reels 34 along a payline 56. It should be appreciated that the present invention includes one or more paylines, such as payline 56, wherein the paylines can be horizontal, diagonal or any combination thereof.

Multiple Potential Award Sets

Figure 3:
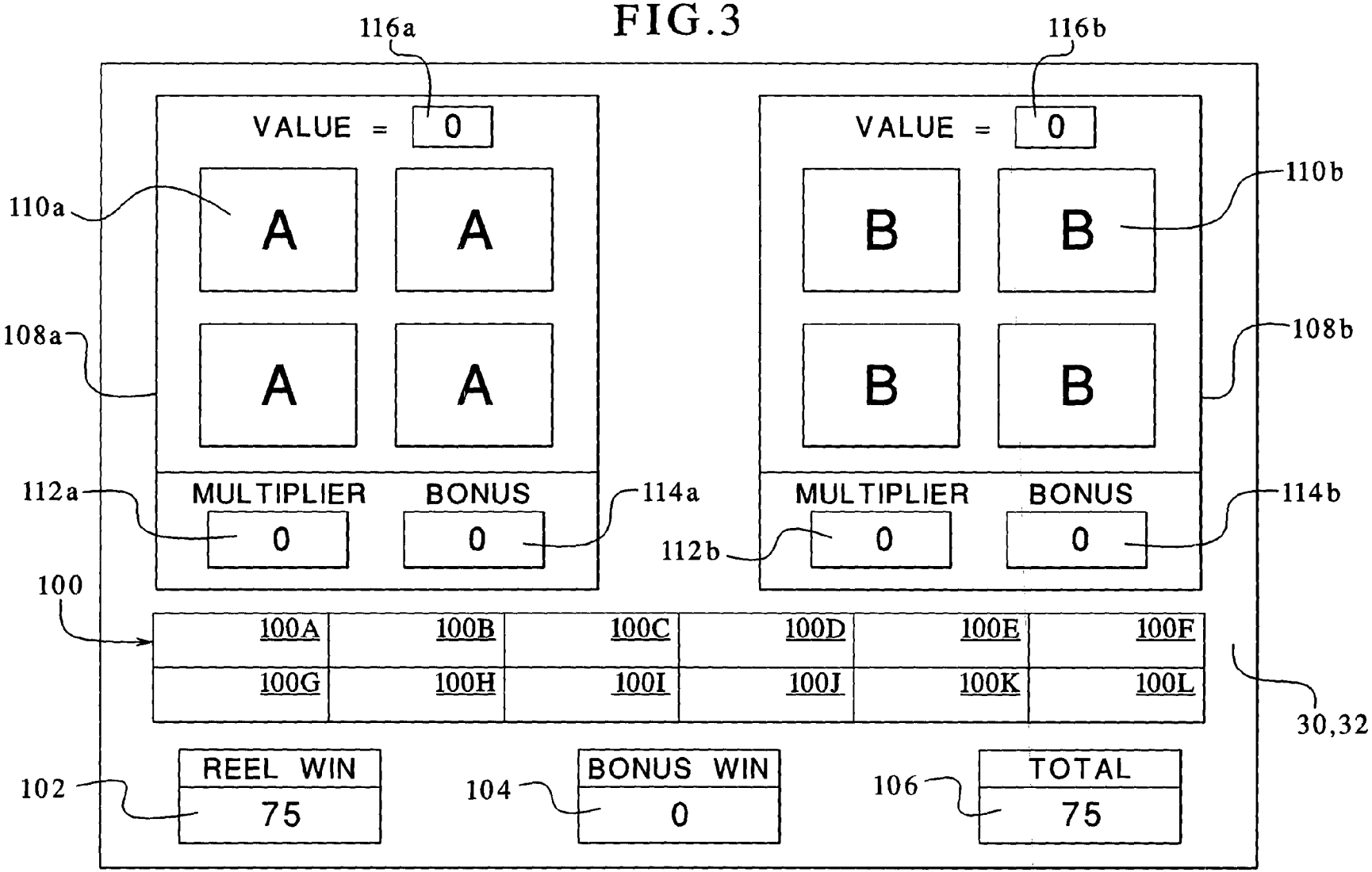
FIG. 3 is an enlarged front elevational view of one of the display devices of FIGS. 1A and 1B, which illustrates one general embodiment of the present invention.
Figure 4:
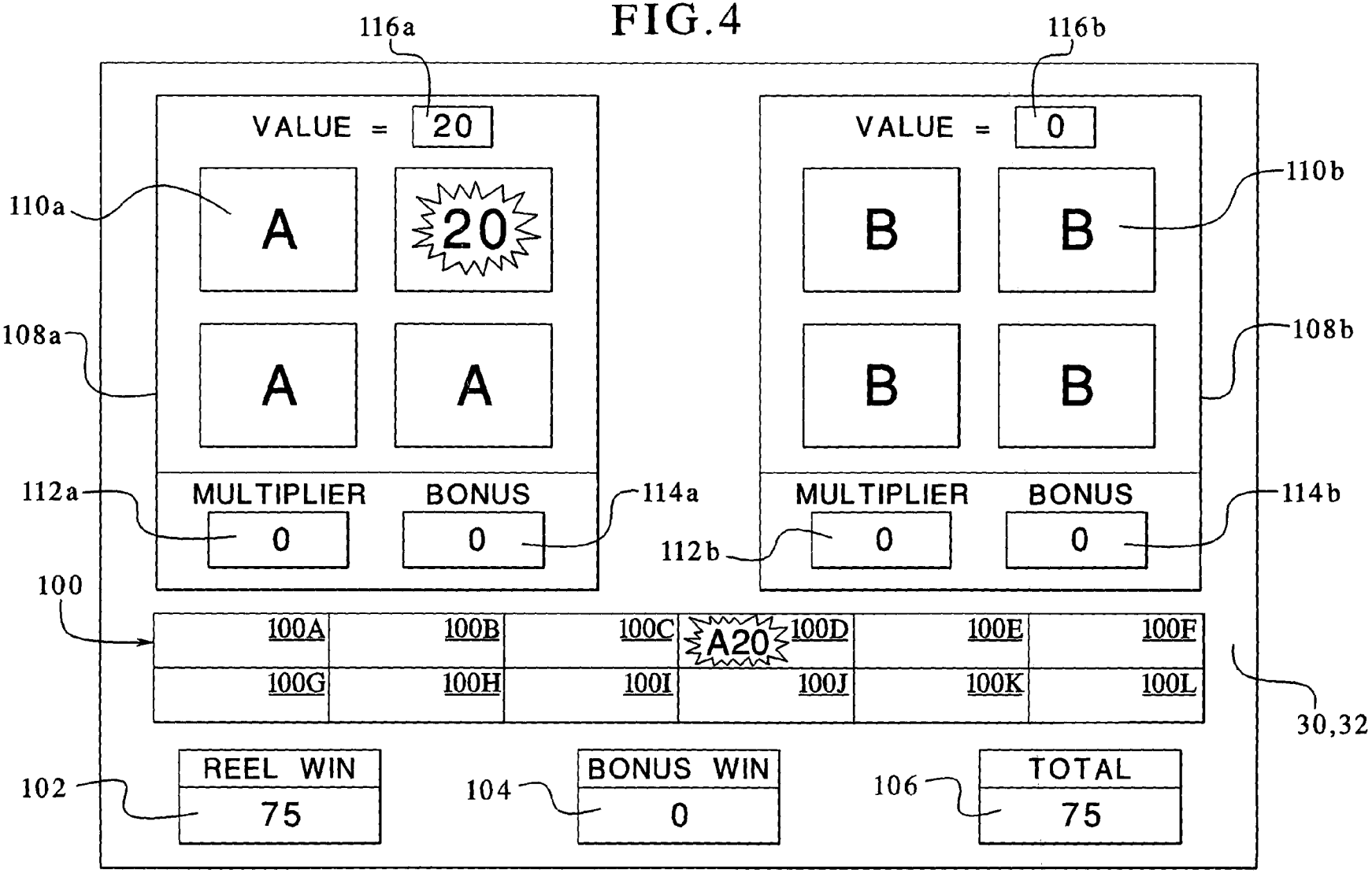
FIG. 4 is an enlarged front elevational view of one of the display devices of FIGS. 1A and 1B illustrating a first selection by a player.

Referring now to FIG. 3, one general embodiment of the present invention includes a display on a display device 30 or 32 having a plurality of masked selections 100 (including selections 100*a*, 100*b*, 100*c*, 100*d*, 100*e*, 100*f*, 100*g*, 100*h*, 100*i*, 100*j*, 100*k* and 100*l*) and at least two sets 108*a* and 108*b*. The selections 100 are preferably simulated selections on the display device 30 or 32, and the display device preferably includes a touch screen 50 and associated touch screen controller 52 (see FIG. 2). Each selection is a separate area of the display device adapted such that when a player touches an area, the touch screen 50 and controller 52 send a discrete input to the processor 38.

The selections may alternatively be electromechanical input devices 44 mounted to the cabinet of the gaming device 10 (see FIG. 2). The electromechanical selections are adapted such that when a player touches or presses a selection, the input device 44 typically closes a circuit (not illustrated), which sends a discrete input to the processor 38. One preferred embodiment of the present invention includes twelve selections, 100*a* through 100*l* as indicated above; however, the present invention may include any suitable number of selections. All of the selections are preferably masked, although it should be appreciated that certain selections may not be masked. Any symbol or indicia could be used in connection with a masked selection as desired by the implementer.

The paid display 102 is preferably simulated on the display device 30 or 32, as illustrated, but may alternatively be an electromechanical device mounted to the cabinet of the gaming device 10. The paid display 102 indicates the value of any recent award paid to the player and is distinguishable from the credit display 16, which shows the recent award plus the player's previous total award.

The bonus game display 104 shows the award received by a player for completing a set or finishing the game. In addition, the total display 106 shows the total credits that the player received in the bonus game, which is the sum of the paid display 102 and the bonus game display 104.

In the preferred embodiment, each set 108*a* and 108*b* preferably includes a plurality of components, and specifically a plurality of value components 110*a* and 110*b*, respectively, having symbols or component identifiers associated with each set, at least one modifier component 112*a* and 112*b*, respectively, and at least one bonus component 114*a* and 114*b*, respectively. Each set includes at least one component and preferably includes a plurality of components as desired by the implementer. The components may be black or related to indicia such as symbols, which may be letters, numbers, shapes or any other characteristic desired by the implementer. The player generates the value components displayed in the sets by picking the selections. When a player generates all the value components located within a set, the bonus game ends. Thus, a player's objective is to complete the set having the highest award and receive the award associated with that set. Preferably an award consists of credits, but the award may include other types of awards such as merchandise as desired by the implementer of the game.

As shown in FIG. 3, the sets 108*a* and 108*b* each include at least one value component. Sets 108*a* and 108*b* each include four value components 110*a* and 110*b*, respectively, but it should be appreciated that a set may include one value component or several value components. The sets 108*a* and 108*b* may also include other components. In FIG. 3, the sets 108*a* and 108*b* include modifier components 112*a* and 112*b*, respectively, and bonus components 114*a* and 114*b*, respectively. These components are preferably simulated indicators on the display device 30 or 32, as illustrated, and are alternatively electromechanical devices mounted to the cabinet of the gaming device 10. Each set 108*a* and 108*b* also includes total value displays 116*a* and 116*b*, respectively, for displaying the total value of each set.

The modifier component includes any modifiers such as multipliers that the player receives for that set. The modifiers may be any mathematical operation, calculation, value or factor desired by an implementer. Preferably, the modifier will be a multiplier. Modifiers may be associated with one set or more sets. It is contemplated that a player may receive a modifier in each set, one set or no sets. A modifier modifies a player's total value for a set. Therefore, the modifier changes the award for the set and enhances the player's excitement and enjoyment of the game.

The bonus component includes bonuses such as bonuses that a player receives during a game. The bonuses may be associated with one set or several sets within a game. In a game, a player may receive bonuses in each set or in all of the sets. Once a set is complete, the bonuses are added to the value components to attain a total award for a set.

The set value displays 116*a* and 116*b* displays the total value of the sets 108*a* and 108*b*, respectively, where the total value is determined as the sum of the value components and any bonuses, modified by any modifiers. The total value is preferably the award associated with the set. Thus, when a set is completed by a player and the game ends, the award shown in the set value display in the set provided to the player is transferred to the bonus win game display 104.

FIG. 3 illustrates one embodiment of a display device 30 or 32, as it may appear to a player when the game begins. The value components 110*a* and 110*b* in the sets 108*a* and 108*b* may be individually generated (i.e., a selection relates to a specific component) or generically generated (i.e., a selection relates to any value component in the set). The selections 100 are preferably masked when the game begins. The selections 100 provide the components as a player picks the selections. The selections are unmasked as the selections are picked. After being picked, the selections preferably remain unmasked until a set or required components of a set are completed and the game ends. Alternatively, a selection may be re-masked and returned to the group of selections the player can choose from.

The modifier components 112*a* and 112*b*, bonus components 114*a* and 114*b* and the set values 116*a* and 116*b* all begin the game at a predetermined value. In addition, the bonus win game display 104 and the total award display 106 start at a predetermined value. The paid display 102 starts with a value associated with a previous game, games such as the bonus triggering game.

FIGS. 4 through 9 illustrate an example play of the game from beginning to end, which occurs when a set is completed by a player. In FIGS. 4 through 9, only six picks are needed to complete the game. It should be appreciated that more or less picks may be needed to complete a game. The number of picks needed to complete a game depends on the number of sets, the number of components in each selection, and the number of components in each set (including the components needed to complete a set).

The player starts the game by picking one of the masked selections 100. In this example, the player picks the selection 100D which is a value component. Each value component preferably includes a set indicator and a value. It should be appreciated that a value component may be associated with a set indicator, a value or any combination of indicators and values. In this example, the value component 110D has or is associated with an indicator "A" for the first set 108*a* and a value of "20." The value component is transferred to the first set 108*a* based on the set indicator. Once the value component is transferred to the first set 108*a*, the set value display 116*a* shows the present value of the first set, which is the cumulative value of the value components 110*a*, any bonuses in the bonus component 114*a*, modified by any modifiers in the modifier component 112*a*. In this example, the value of the bonus component 114*a* and the modifier component 112*a* are zero, therefore the set value display 116*a* shows the present value of the first set 108*a* after the first pick by the player, which is twenty.

Figure 5:
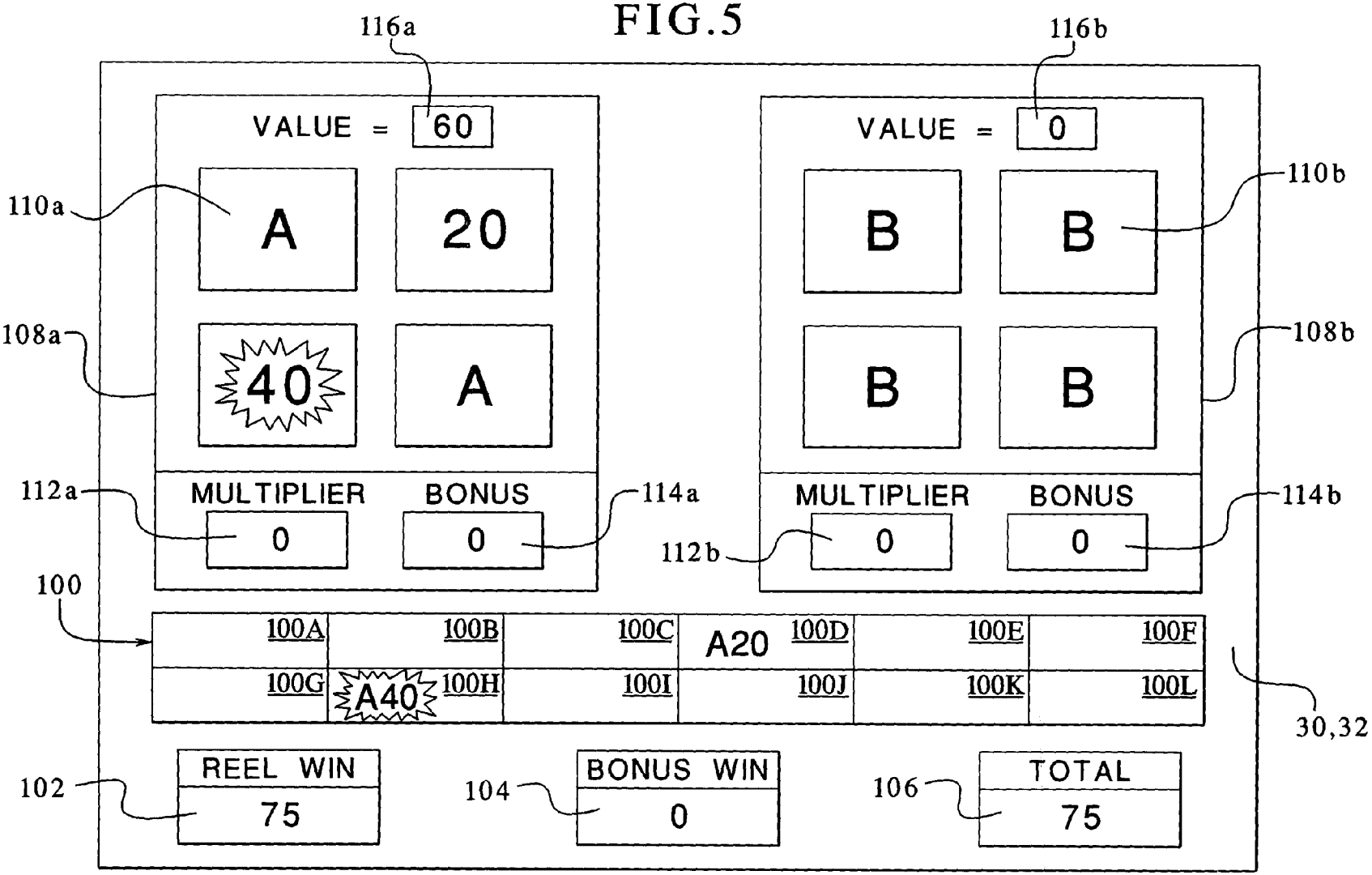
FIG. 5 is an enlarged front elevational view of one of the display devices of FIGS. 1A and 1B illustrating a second selection by a player.

FIG. 5 illustrates the second pick by the player in the game. The player picks selection 100H which is a value component which is associated with the first set 108*a* and has a value of "40." The second value component is transferred to the first set 108*a* and the total value or award for the set is shown in the set value display 116*a* which is sixty (i.e., the cumulative value of the value components, bonuses and modifiers associated with the first set 108*a*).

Figure 6:
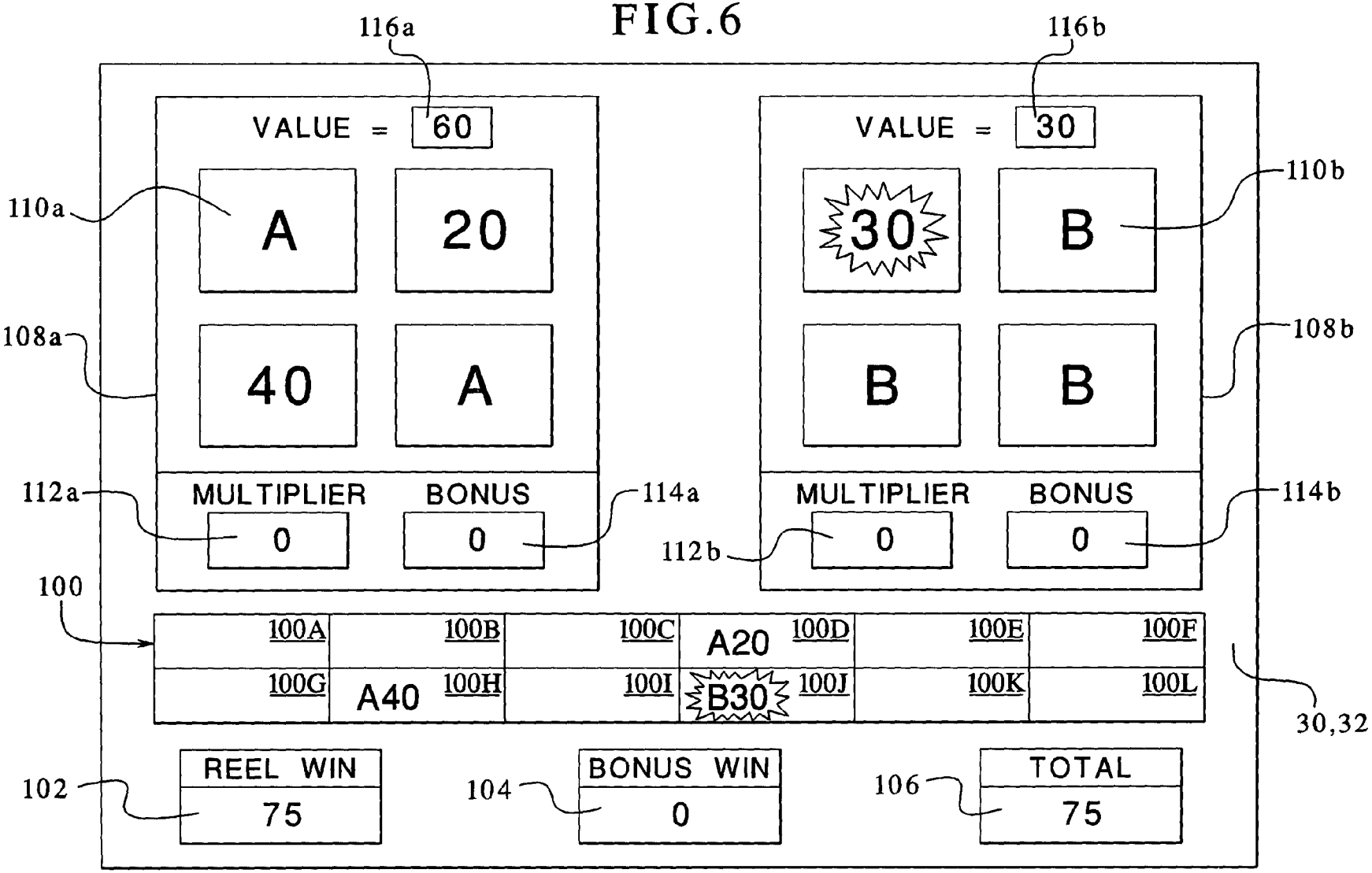
FIG. 6 is an enlarged front elevational view of one of the display devices of FIGS. 1A and 1B illustrating a third selection by a player.

FIG. 6 illustrates the player third selection 100J. The third selection 100J display a value component which has an indicator "B" that associates this component with the second set 108*b*. The value component has a value of "30" which is transferred to set 108*b*. The set value display 116*b* for the second set 108*b* shows the present value for the set. At this point, the second set 108*b* has a total value or award of thirty, which is the sum of any value components 110*b* and bonus components 114*b*, modified by the modifier component 112*b* for that set.

It should be appreciated that a player may complete either the first set 108*a* or the second set 108*b*. In the embodiment, a set is completed when all of the value components in the set have values. Preferably, the sets are not completed at the same time. If they are, both sets could be provided to the player or an alternative award may be provided to the player. The player's goal is to complete the set that will give the player the highest value for the game.

Figure 7:
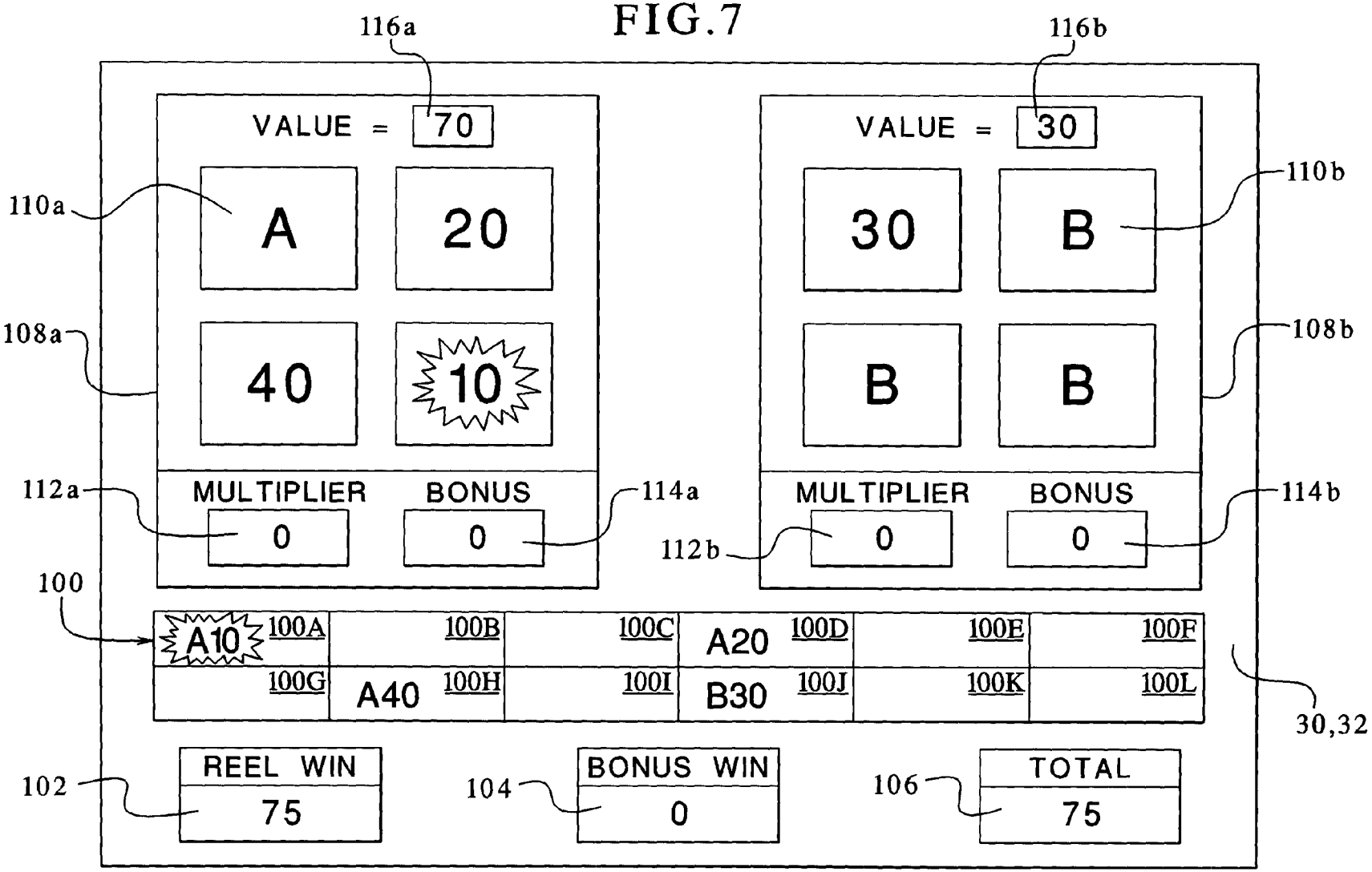
FIG. 7 is an enlarged front elevational view of one of the display devices of FIGS. 1A and 1B illustrating a fourth selection by a player.

FIG. 7 illustrates the player's fourth selection 100A, which provides a value component that includes an identifier associated with the first set 108*a*. The value of the value component is transferred to the first set 108*a*, as illustrated. The value of the first set 110*a* becomes seventy, as displayed in the set value display 116*a*.

Figure 8:
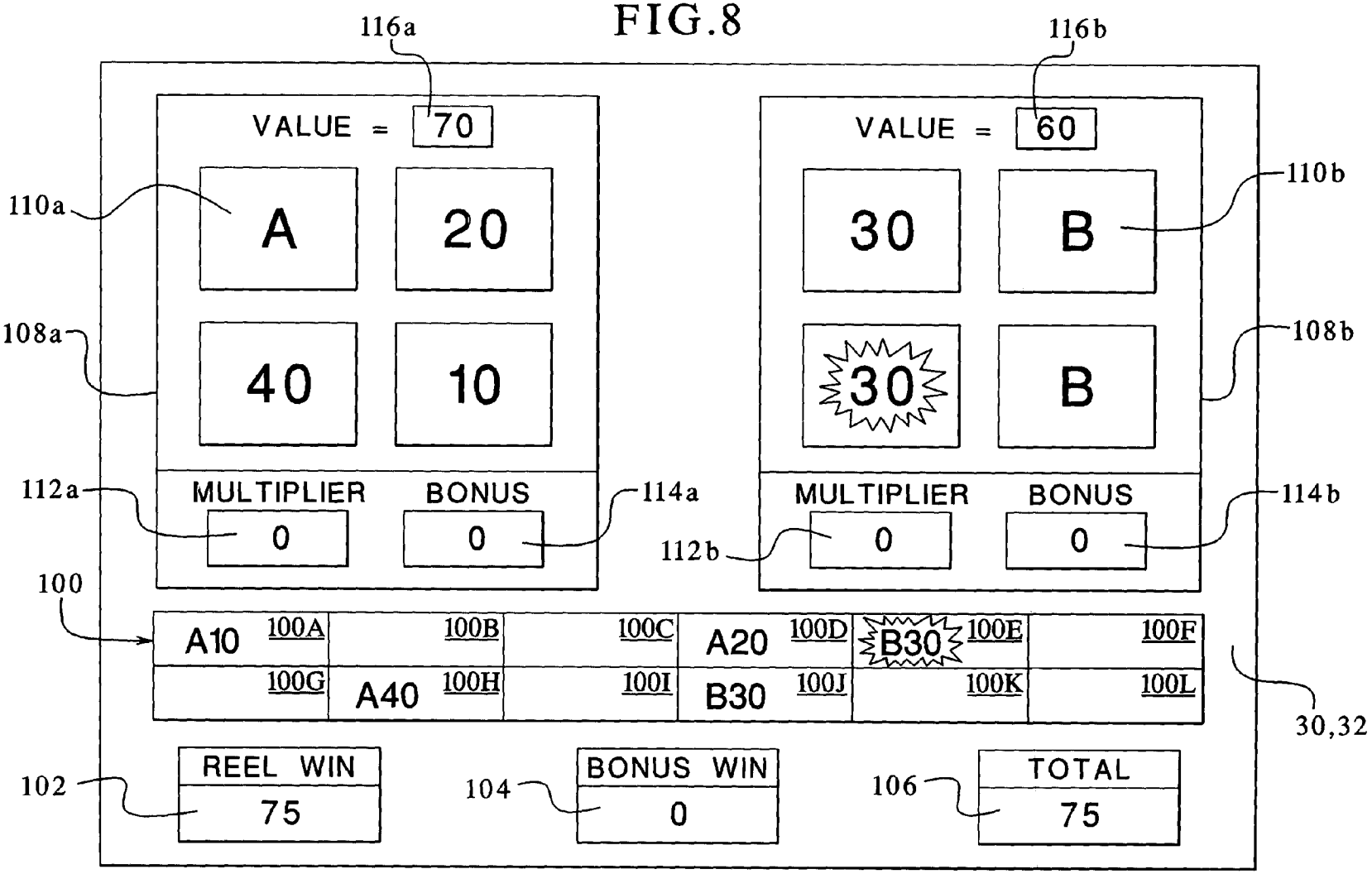
FIG. 8 is an enlarged front elevational view of one of the display devices of FIGS. 1A and 1B illustrating a fifth selection by a player.

FIG. 8 illustrates the player's fifth selection 100E which provides a value component which is associated with the second set 108*b*. The value "30" of the value component is transferred to the second set 108*b* and added to the total value of that set or shown in the set value display 116*b*.

Figure 9:
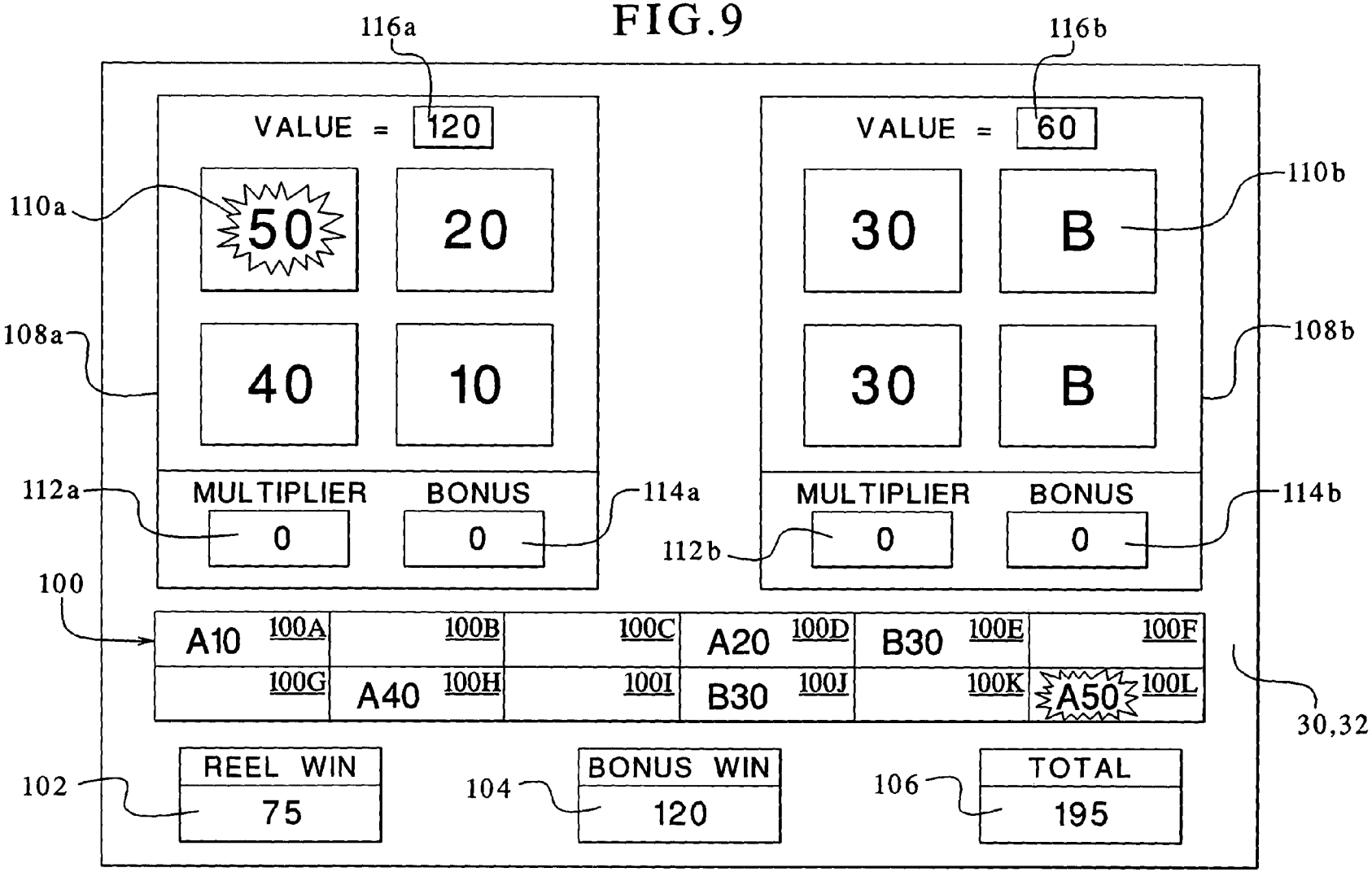
FIG. 9 is an enlarged front elevational view of one of the display devices of FIGS. 1A and 1B illustrating a final selection by a player that completes a set.

FIG. 9 illustrates the player's sixth selection 100L, which provides a value component associated with the first set 108*a*. The value "50" is transferred to the first set 108*a*, as illustrated. The value of the first set 108*a* is one hundred twenty, as displayed in the set value display 116*b* for the first set 108*a*. The present value of the first set 108*a* is the sum of all four value components and any bonus components for that set, modified by any modifier components for that set. In this example, there are no bonus or modifier components, therefore the total award for set 108*a* is the sum of the value components 110*a*. It should thus be appreciated that the present invention can be employed with value components and without modifier, bonus or other components.

The sixth pick by the player was the final pick of the game because this pick completed the first set 108*a* which was the requirement of this embodiment. Once a set is complete in the preferred embodiment, the game ends and the player receives the total value or award associated with that set. In this example, the player receives the value indicated in the set value display 116*a* for set 108*a*, which is one hundred twenty. This value is now transferred to the bonus game display 104. Since the game has ended, the value in the paid display 102 is added to the value in the bonus game display 104 to give the player their total award shown in the total award display 106. In this example, the player receives seventy-five plus one hundred twenty to give them a total award of one hundred ninety-five.

It should be appreciated that the player could have completed the second set 108*b* before the first set 108*a*. Therefore, the outcome of the game is dependant on the selections 100 that the player picks during the game. In some games, the player may desire to complete one set before another because that set has a higher total award than the other set or sets. The uncertainty related to the completion of the sets enhances the player's excitement and enjoyment of the game.

In another embodiment of the game, a player picks a selection 100 and receives a bonus component associated with a particular set. The bonus component can be added to one or more sets or to all of the sets in a game. A game may have no bonus components or as many bonus components as desired by the implementer of the game, provided that the sets can be completed. It should also be appreciated that a bonus component can be used as a partial or complete set completion component (i.e., picking a bonus component is required to complete a set, is part of completing a set, equals two or more value components toward completion, or automatically completes a set).

Figure 10:
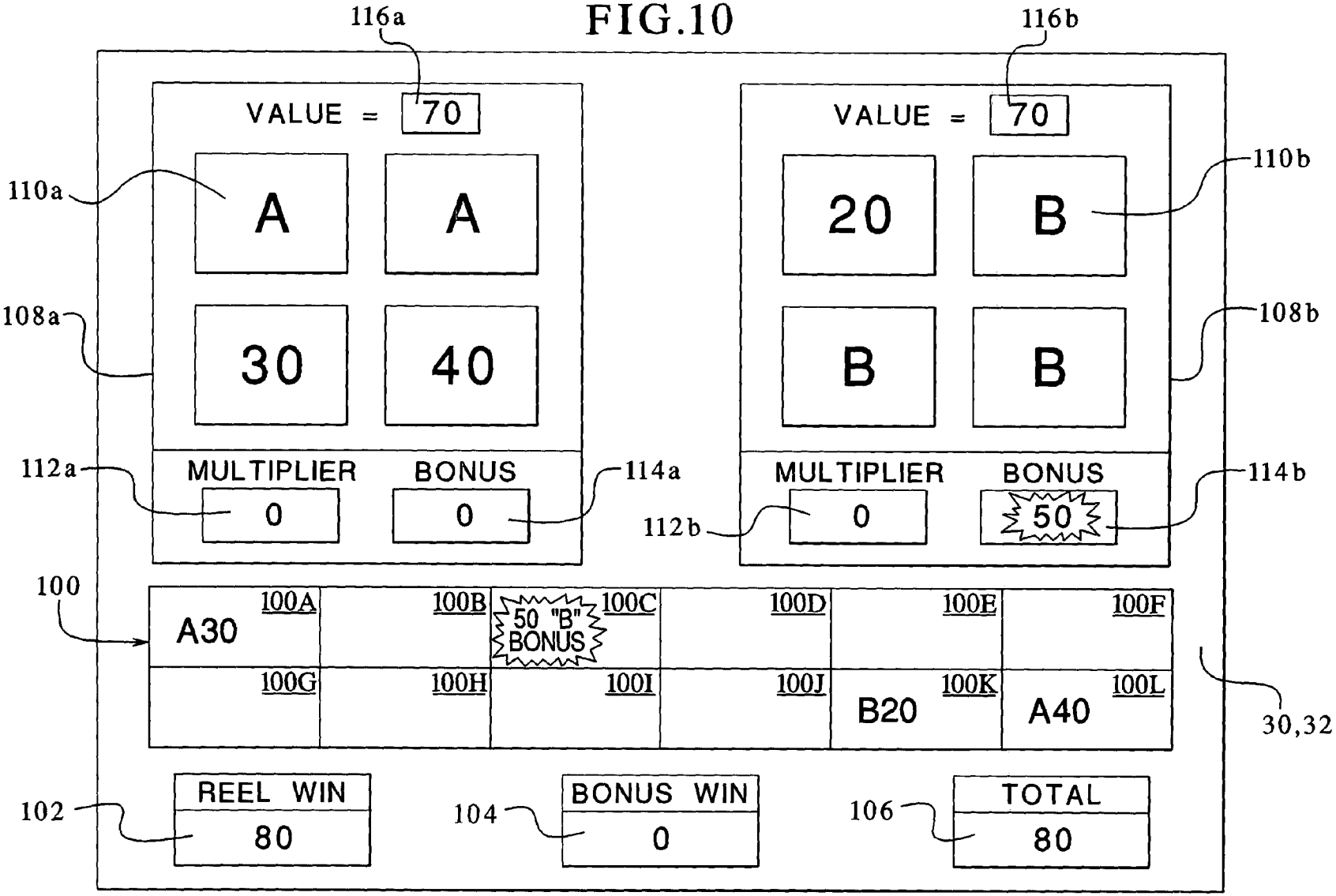
FIG. 10 is a enlarged front elevational view of one of the display devices of FIGS. 1A and 1B illustrating a further bonus component selected by a player.

FIG. 10 illustrates an example game where a player picks a selection 100C that provides a bonus component which includes a set identifier, a bonus identifier "Bonus" and a value "50" associated with it. The set identifier "B" Bonus associates the bonus component with a set. It should be appreciated that a bonus component may be associated with one set, several sets or all of the sets in a game. In FIG. 10, the bonus component is only associated with set 108*b*, and therefore the value of the bonus component is transferred to that set. The bonus component's associated value is fifty and this value is added to the total award for the set in the example illustrated in FIG. 10.

The bonus components add to the total award of a set and increase the awards that a player can win in a game. In some circumstances, the bonus components may make one set more valuable than another set. Since the player's goal is to complete the set with the highest value, the bonus components create larger awards and thereby enhance a player's excitement and enjoyment of the game.

Figure 11:
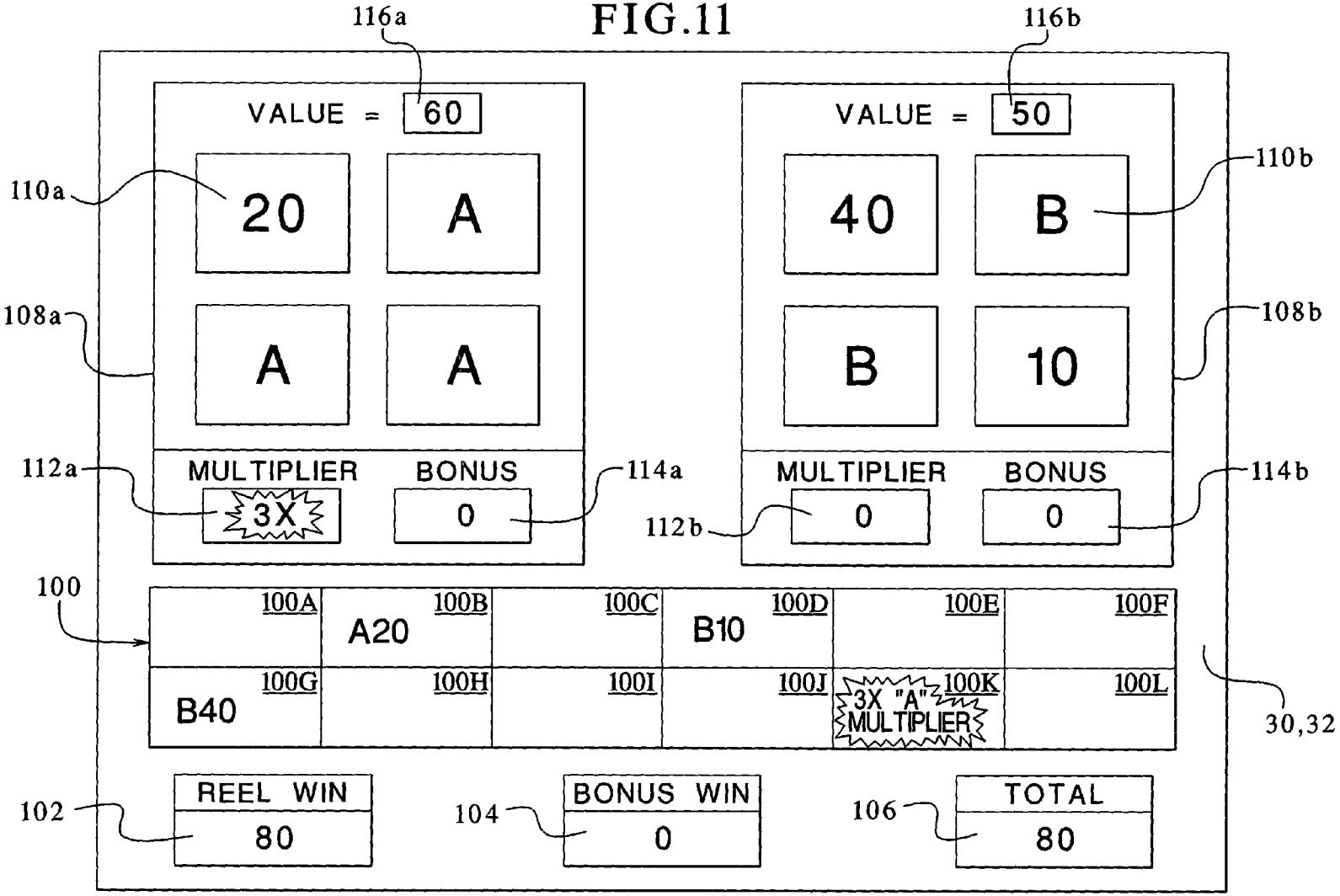
FIG. 11 are enlarged front elevational views of one of the display devices of FIGS. 1A and 1B illustrating a modifier component selected by a player.

FIG. 11 illustrates another example game where a player picks selection 100K. The selection provides a modifier component which has a set identifier "A" that associates the modifier component with set 108*a*, a modifier identifies "Multiplier" that identifies the type of the selection, and modifier "3X." It should be appreciated that a modifier component may be associated with one set, several sets or all of the sets in a game. In FIG. 11, the modifier component is only associated with set 108*a*, therefore the modifier component is transferred to that set. The modifier component is in this example a multiplier, but may be any other type of modifier that changes the award in a set as discussed above.

The award for set 108*a*, including any bonus components, is modified by the modifier to achieve the award for that set as shown in the set value display 116*a*. In this example, the modifier is a multiplier "3X", which means that the sum of the value components and the bonus components in set 108*a* will be multiplied by three to achieve the award for that set.

The modifier component 112*a* increases the total award for the set and increases the award that a player can win in the game. In some circumstances, the modifier may make one set more valuable than another set. The player's goal is to complete the set with the highest value. Therefore, the modifier component increases the awards received by a player and thereby enhances a player's excitement and enjoyment of the game.

Figure 12:
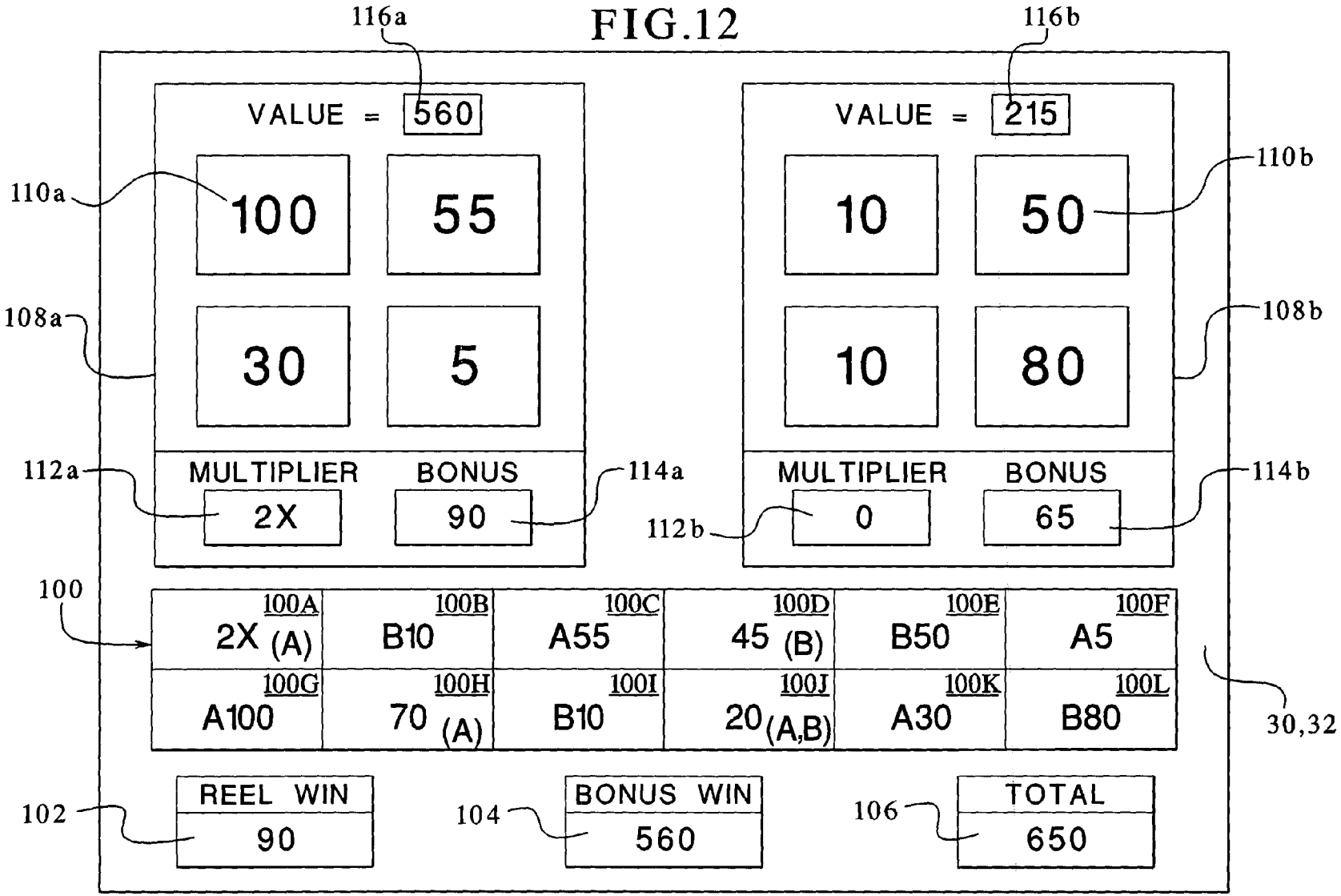
FIG. 12 is an enlarged front elevational view of one of the display devices of FIGS. 1A and 1B illustrating unmasked components and selections.

FIG. 12 illustrates all of the selections revealed. In this example, the present invention includes twelve selections 100 that provide various components and values. The selections provide value components (such as 100*b*, 100*c*, 100*e*, 100*f*, 100*g*, 100*i*, 100*k* and 100*l*) and preferably four value components for each set. The selections also include three bonus components (such as selections 100*d*, 100*h* and 100*j*) and one modifier component (such as selection 100*a*). It should be appreciated that the selections may have more or less than twelve selections and that the number of value components, bonus components and modifier components vary as desired by an implementer.

Referring now to FIG. 13, an award table 118 illustrates at least a portion of an award database that the present invention may employ to generate an award. The award table 118 includes a plurality of awards 120 having any desired predetermined distribution of values. The awards 120 may include bonuses, modifiers or other items of value such as a number of picks from an award pool (not shown). The present invention includes the game being enabled or not being enabled to randomly select an award 120 a plurality of times.

The present invention also includes adapting the game to randomly generate awards 120 from the award table 118 using one of two methods. In a first award generation embodiment, the game randomly assigns an award to each of the selections 100 (FIG. 3) at the beginning of the game. For example, the game randomly assigns the 10 award to a first selection, the 20 award to a second selection, etc., before the player begins picking selections 100. The game then generates an award depending upon which selection 100 the player picks.

In a second award generation embodiment, the game randomly assigns an award 120 to a pick of an order. That is, the player makes a first pick, a second pick, a third pick, etc. The game randomly assigns, e.g., the 10 award to the first pick, the 20 award to the second pick and so on. The present invention includes the game randomly assigning awards to a plurality or all of the picks before the player begins picking selections 100 or alternatively assigning each award directly to a selection 100 after the player picks a selection.

In FIG. 13, the award table 118 illustrates at least a portion of an award database that the present invention employs to generate an award. The awards 120 each include an associated likelihood percentage 122 that the processor 38 (see FIG. 2) utilizes to select a particular award. The game contemplates probabilities or likelihood percentages 122 having any desired distribution, wherein the percentages preferably add to 100%. For example in award table 118, the game is twice as likely to select one of the 15, 20, or 25 awards as it is to select either the 10, 30 or 35 awards.

Similarly, the award table 118 may be employed for each component in a game, including the bonus and modifier components. It should be appreciated that the award tables may employ the same awards or different awards, as well as have the same award likelihood percentages or different award likelihood percentages. Therefore, each award table 118 may have different award values 120 and different award distribution percentages 122.

FIG. 14 illustrates another example of how the game may randomly distribute components within the game based on likelihood percentages. The component distribution table 124 is employed by the processor 38 to distribute components to a particular set or sets based on probabilities or likelihood percentages 126. The component distribution table 124 includes as many set locations 128 as there are sets 108 in a game. The set locations 128 each include an associated likelihood percentage 126 that the processor 38 (see FIG. 2) utilizes to select the particular set location. The game contemplates probabilities or likelihood percentages 126 having any desired distribution, wherein the percentages preferably add to 100%. In this example, a component such as a modifier component is twice as likely to be assigned to set A or set B as it is to both sets A and B. It should be appreciated that a game may employ the same likelihood percentages 126 or each component may have its own component distribution table 124 with likelihood percentages 126.

Preferred Multiple Potential Award Game Embodiment

Referring again to FIG. 12, one preferred embodiment of a multiple potential award game is illustrated fully revealed or unmasked on a display device 30 or 32 to show each of its game outcomes. The preferred multiple potential award game includes at least two sets having one or more value components per set, at least one modifier component, at least one bonus component and a plurality of selections 100.

The preferred multiple potential award game requires the player to pick selections until a set is complete. Any player pick of the selections may generate a value component, multiplier component or a bonus component. Each player pick preferably adds value to the award for a set or both sets. It should be appreciated that alternatively, a selection may not affect a set, may reduce the value of a set, or may change one of the components of a set. Once a player completes a set, the player receives the award associated with that set. Alternatively, the player may receive the value of the last set completed, the value of an intermediate set completed, or some award associated with a completed or uncompleted set. The award is added to any awards that a player received from a previous game or games and a new award total is calculated for the player.

Figure 15:
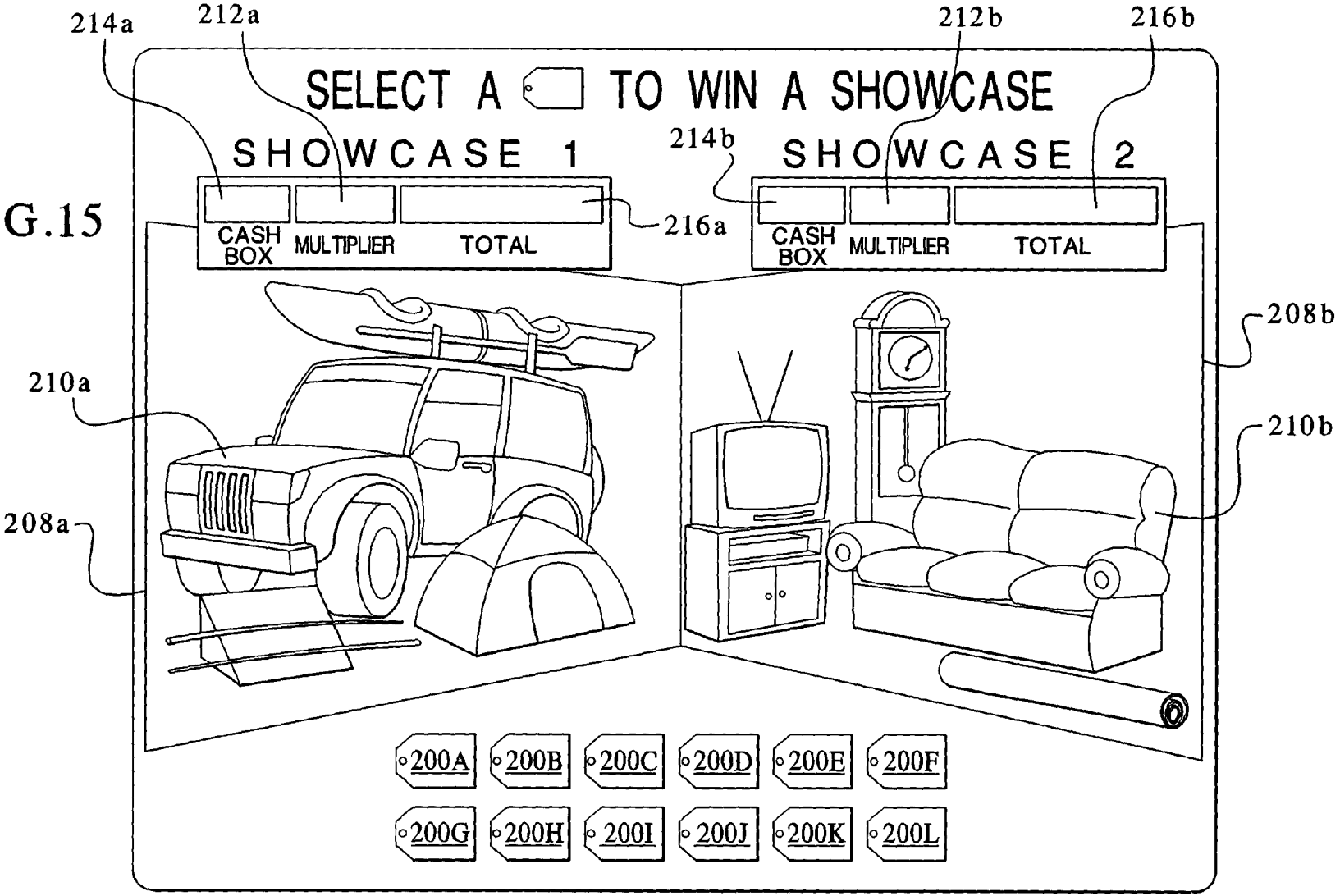
FIG. 15 is an enlarged front elevational view of one of the display devices of FIGS. 1A and 1B illustrating an embodiment of the invention where the value components are different objects which represent values.

FIG. 15 shows a further embodiment of the present invention where the potential award sets 208*a* and 208*b* include value components such as 210*a* or 210*b*, that are objects or items which represent a value. Alternatively, the object could be prizes awarded to the player which is the item itself. In this embodiment, a player picks one of the selections, 200A to 200L. The player's selection reveals an item associated with one set or more than one set. Each item is associated with a value, which is transferred to the associated value component, 210*a* or 210*b*, for each set. The player completes a set or sets by picking all the value components 210*a* or 210*b* for the set. Once a set is completed, the player receives the total value for that set associated with the items in the set.

The total value of a set is based on the bonuses, modifiers and value components picked by the player for that set. The bonus values, if selected, are displayed in the bonus value components 214*a* and 214*b* for each set. Similarly, modifier values such as multipliers, are shown in the modifier components 212*a* and 212*b* for each set. The total value of a set is determined by adding the value components and any bonus values selected by a player. This sum is then modified by any modifier values selected by the player and the resultant total is displayed in the set value components 216*a* and 216*b* for each set.

In FIG. 15, the first set 208*a* includes items associated with an outdoor theme illustrated by the truck, tent, canoe and fishing poles. The second set 208*b* includes items associated with a household theme illustrated by the couch, television, rug and clock. A player picks a selection 200A to 200L. Subsequently, the picked selection reveals a value component from either set 208*a* or 208*b*. It is contemplated that a selection may reveal a value component associated with more than one set. If the player's selection reveals the truck, a value associated with the truck is transferred to the value component 210*a*. If the selection reveals the couch, a value associated with the couch is transferred to the set value component 210*b*. The picked selections may also reveal bonuses and modifiers that add to the potential award for a set.

A player completes a set by selecting each value component within a particular set. For example, if a player picked selections 200 such that they revealed the truck, tent, canoe and fishing poles, the player completes set 208*a*. The total value of the components is added to the bonus values picked by a player and then modified by the modifier value, any, shown in the modifier components 212*a* 212*b* to achieve the total value of the set as displayed in the set value component 216*a* and 216*b*. The set value component is the total award that the player receives for completing that set.

Figure 16:
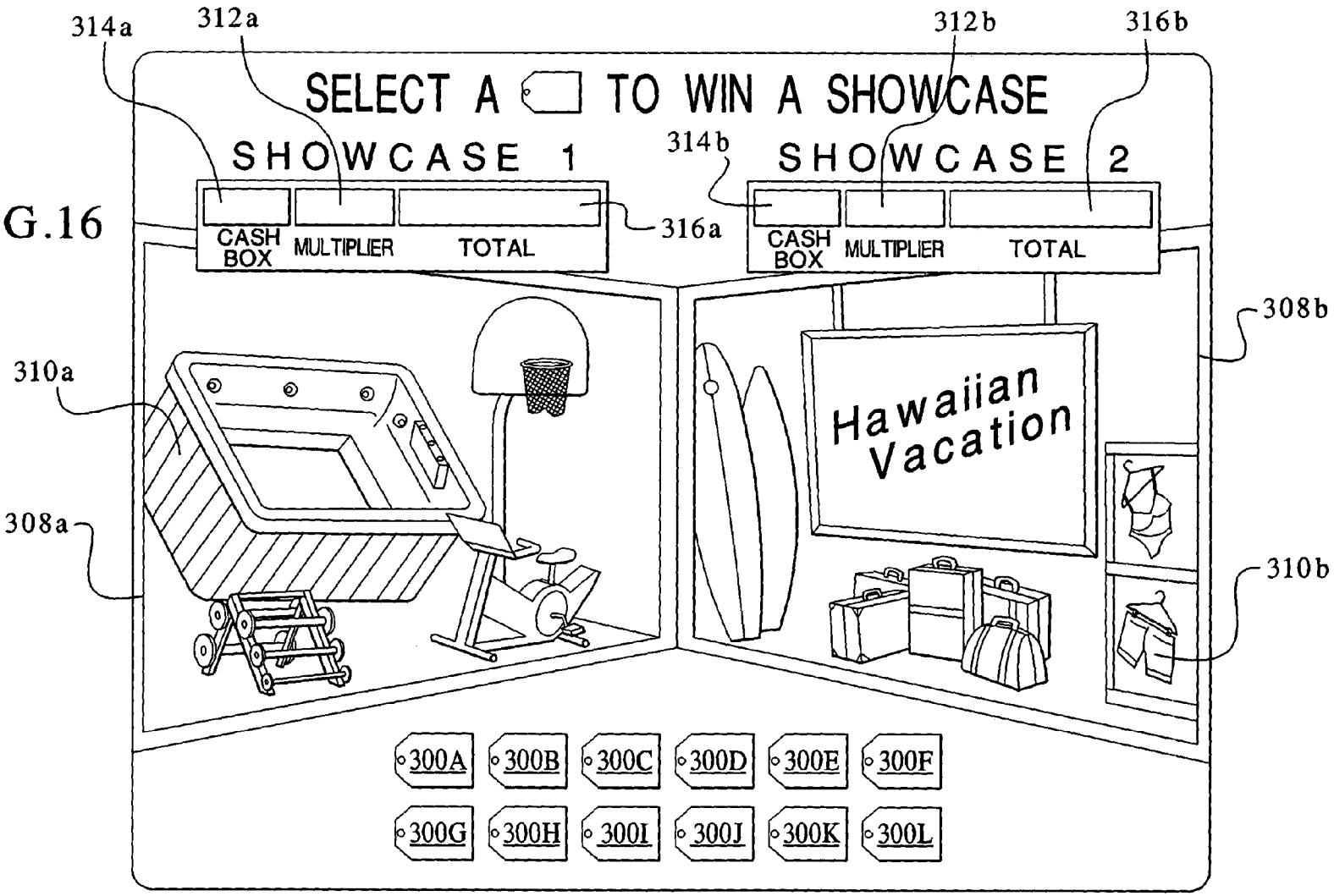
FIG. 16 is an enlarged front elevational view of one of the display devices of FIGS. 1A and 1B illustrating another embodiment of the invention where the value components are different objects which represent values.

FIG. 16 illustrates another embodiment where the value components of set 310*a* are recreational items such as a hot tub, basketball hoop, exercise bike and dumbbells. In set 310*b*, the value components are associated with a trip or vacation and include a Hawaiian vacation, surfboards, luggage and bathing suits.

A player picks the selections 300 until the player completes one of the sets 310*a* or 310*b*. For example, a player may pick selections 300 and reveal the hot tub, basketball hoop, exercise bike and dumbbells. If the player picks these value components before picking all of the value components in set 308*b*, then the player receives the total value of the recreational set 308*a*.

The value of the recreational set 308*a* is the total value of the components of that set. Each component, the hot tub, basketball hoop, exercise bike and dumbbells, are associated with a value. When that component is selected, the component value is transferred to the set value component 310*a* and/or 310*b*. Once the set is completed, the set value component 310*a* or 310*b* is modified by the modifier value, if any, in 312*a* and 312*b*. The total value is then displayed in the set value component 316*a* and 316*b*. The total value shown in the set value component is the award that the player receives for completing that set.

Similarly, if the player completed set 308*b* first by selecting the Hawaiian vacation, surfboards, luggage and bathing suits, the player receives the award shown in the total value component 316*b*. The total value component is the sum of the value components 310*b* plus any bonus values shown in 312*b*, and then modified by any modifiers selected in the game.

Awards Associated with Component Groups

Figure 17:
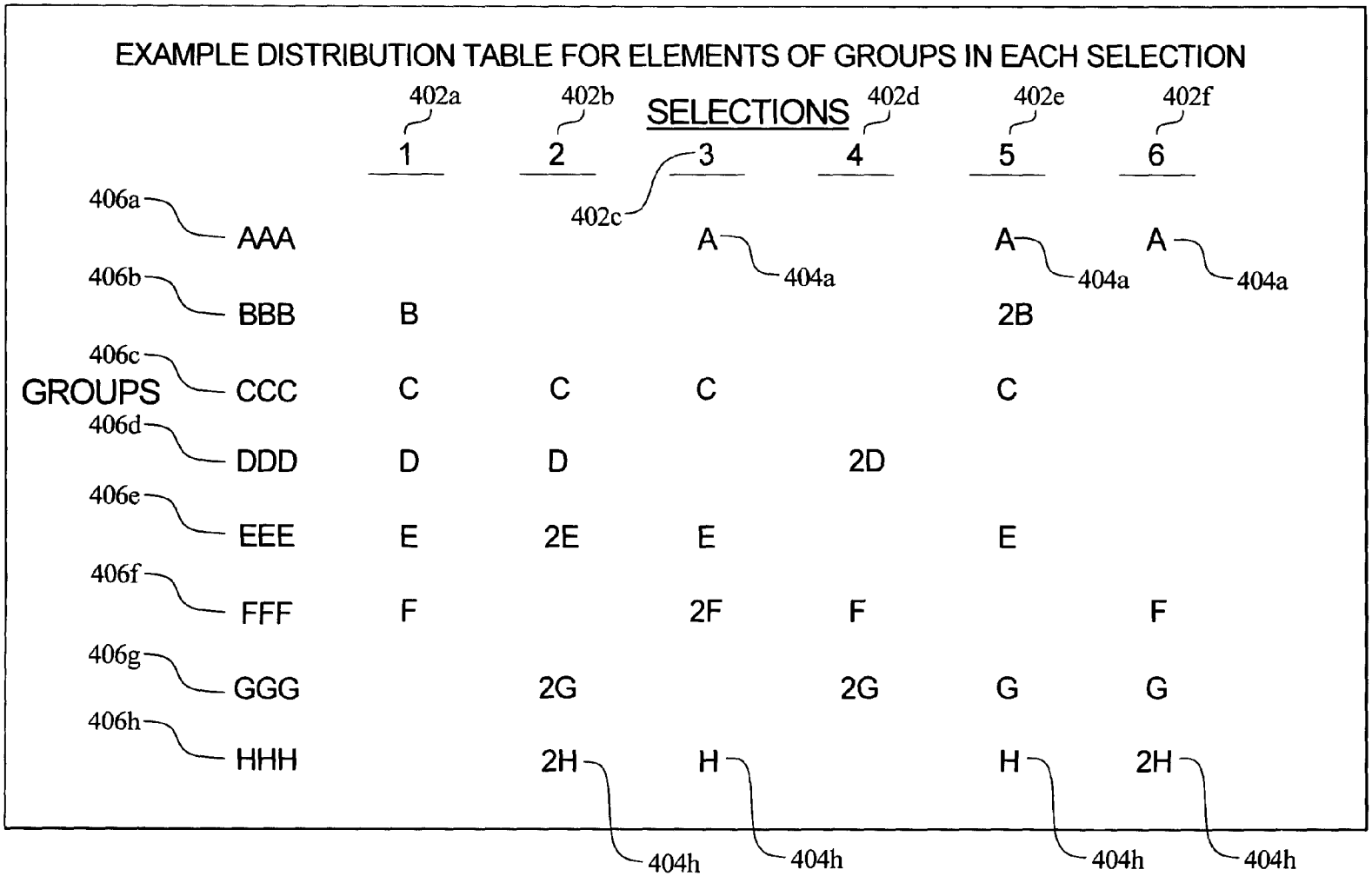
FIG. 17 is a table illustrating an example distribution of set components among the selections of one alternative embodiment of the present invention.

Referring now to FIG. 17, in an alternative embodiment of the present invention, the gaming device display device 30 or 32 displays a plurality of masked selections 402*a* to 402*f* and a plurality of sets or groups 406*a* to 406*h*. The groups each include a predefined number of components represented by any suitable symbol, image, indicia or other identifier associating that component with a particular group. The components in the illustrated embodiment include the letters, A, B, C, D, E, F, G and H. In one alternative embodiment, the components in each group are related or identical. In the illustrated embodiment, each component by itself has no value. In alternative embodiments, the component symbols may additionally represent modifiers, awards, bonuses, or other outcomes that alter the outcome associated with the group.

In one embodiment, each selection 402*a* to 402*h* includes at least one component and, preferably, a plurality of components from different groups. As indicated above, FIG. 17 illustrates an example distribution of the components or elements 404*a* to 404*h* of each group or group 406*a* to 406*h* among the selections 402*a* to 402*f* provided to the player. In this embodiment, only three components in each group are necessary to fill or complete that group. The game illustrated in FIG. 18 has eight groups 406*a* to 406*h* of three identical components. It should be appreciated that alternatively the number of components required to fill or complete a group may vary with each group or, at least one of the components associated with a group is predetermined to "fill or complete the group." The components associated with each selection can be predetermined or randomly selected upon the initiation of each game.

In one embodiment, each selection has a different associated array or plurality of components. In one embodiment, as indicated above, the components are randomly associated with the selections for each game. It should be appreciated that the components can be otherwise suitably associated with the selections such as using predetermined associations, probability tables or other suitable methods. The associations can be made before or alternatively after the player picks the selections so that the gaming device can control the outcome. The gaming device can also change the associations during a game such as after each pick of a selection. Each selection may have a variable number of components 404 associated with that selection. For example, in the illustrated embodiment, selection 402*a* has five associated components. In contrast, selection 402*e* has seven associated components. It should be appreciated that the implementer can arrange the association of components for each selection to effect the probability of winning a particular outcome associated with a particular group.

In one embodiment, all of the components associated with the selections are initially masked, unknown to, or hidden from the player at the time the player makes a selection. Upon making a selection, the game displays the components associated with that selection, and those components are placed, displayed or indicated in their respective groups. In an alternative embodiment certain components of the selections are not masked. Alternatively, the components required to complete a group are displayed and subsequently indicated upon their selection. It is preferable that no selection contain all of the components needed to fill one of the groups.

As illustrated in FIG. 17, the number of components distributed among the various selections are, in one embodiment, dependent on the value of the outcome or outcomes associated with the group of those components. For example, the greater the value of the outcome associated with the group of those components, the fewer the number of components available among the selections and, consequently, a lower likelihood for those components to be selected. In FIG. 17, for example, because filling the "A" group 406*a* in FIGS. 18 to 21 provides a player a relatively high outcome 408*a*, of one thousand credits, there are only three "A" components 404*a* associated with the selections 402*a* to 402*f*. In this embodiment, outcomes associated with groups having lower values, will have an increasing number of components from that group associated with the selections. Again, referring to FIG. 17, because a player only receives ten credits 408*h* for completing the "H" group 406*h*, six "H"s 404*h*, instead of three, are distributed among the selections 402*a* to 402*f*.

Alternatively, the distribution of components among the various selections is expressed as a probability associated with each group, wherein the probability determines the likelihood that the components of that group will be selected.

As the player makes selections, the components associated with each selection selected by the player are matched with their respective groups. When at least one of the groups has been completed or, in an alternative embodiment, when a predetermined number of selections have been made, the player receives the outcome or plurality of outcomes associated with the completed group or groups.

A group is completed when a predetermined number of components (such as all of the components) or, alternatively, a percentage of the components associated with a particular group or groups are selected. In a further embodiment, a group is completed if particular predefined components are selected. In an alternative embodiment, different groups have a different number of components required to fill that particular group. In such an embodiment, it is preferable that the number of components required to fill a group corresponds to the value of the outcome associated with the filled group.

Figure 18:
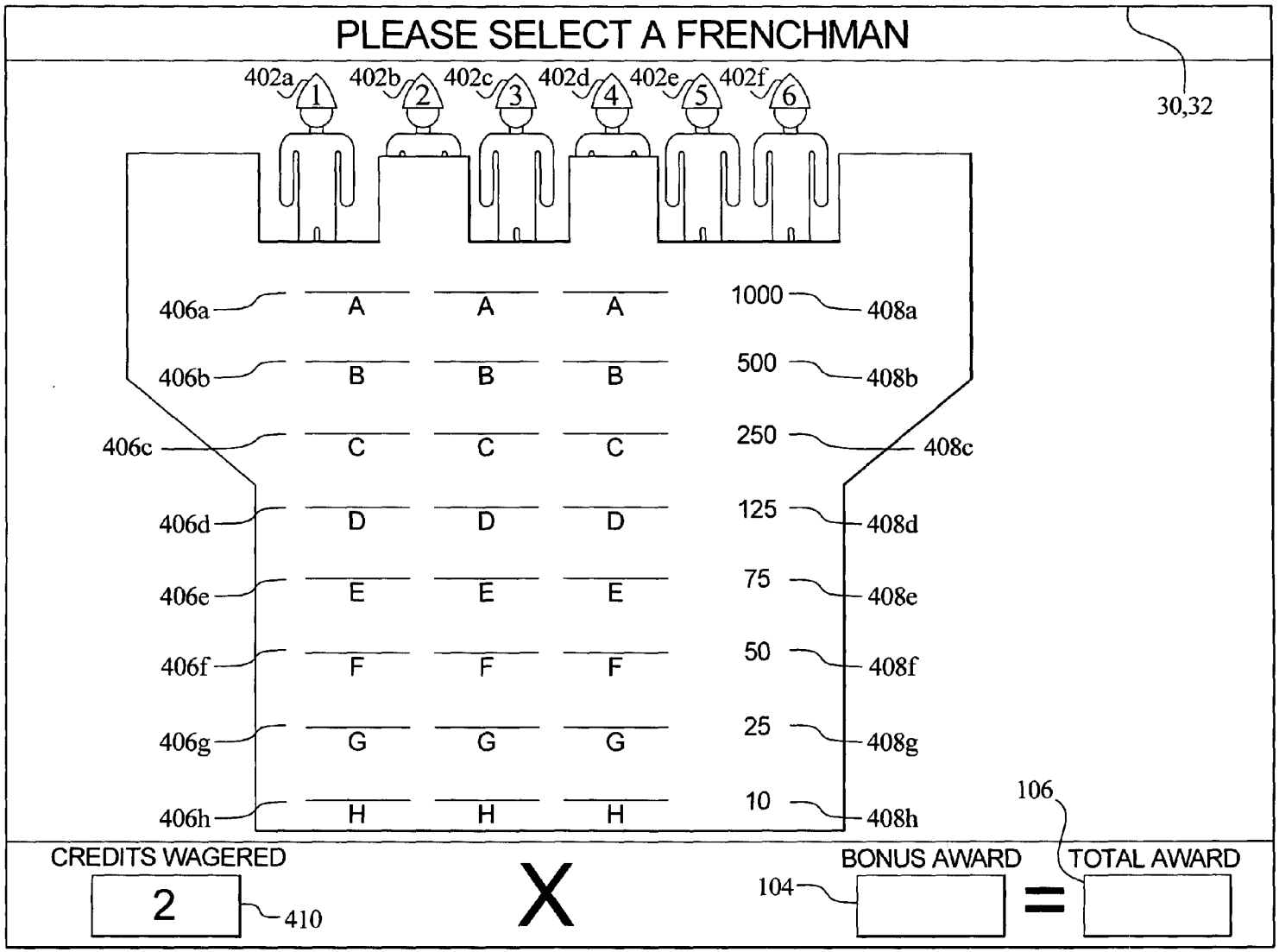
FIG. 18 is a front elevational view of one of the display devices of FIGS. 1A and 1B prior to a selection by a player in an example of one embodiment of the present invention.

In one embodiment, an outcome is associated with each group. The outcome may be a value, modifier, bonus game or other suitable outcome. The game provides the player the outcome associated with the group when the player has completed that group. FIG. 18 illustrates one embodiment where outcome 408*a* to 408*h* are associated with groups 406*a* to 406*h*, respectively. The outcomes in the illustrated embodiment are credit value outcomes ranging from ten to one thousand credits. It should be appreciated that a particular outcome may be associated with more than one group. Moreover, it should be appreciated that any number of different outcome values can be associated with any number of component groups. Alternatively, a group may have no associated outcome. In such an embodiment, the filling of such a group can function as a terminating event in a game that ends when the first group or a determined group is filled.

In one embodiment, the player wins an outcome associated with a filled group because that group was the first to be completed. In a preferred embodiment, the player can simultaneously win multiple outcomes upon the simultaneous completion of multiple groups. In an alternative embodiment, the player receives the outcome associated with any filled group when the player has used all of the predetermined number of selections provided by the gaming device.

FIG. 18 illustrates an example embodiment that adopts a theme related to a famous scene from the movie, Monty Python and the Holy Grail where Frenchmen standing on a castle taunt the hapless seekers of the Holy Grail by hurling insults down on them. The selections 402*a* to 402*f* made available to the player are represented by six Frenchmen. The present invention may, however, include any suitable number of selections, and any symbol, images or indicia could be used in connection with the selections as desired by the implementer. In this example, the components included in each selection are represented by insults and are displayed as being thrown over the wall of the castle as the player chooses a particular Frenchman.

The groups 406*a* to 406*h* illustrated in FIGS. 18 to 21 each include three spaces representing the predetermined number of components associated with each group. The spaces of each group await the accumulation of respective components 404*a* to 404*h* associated with the selections 402*a* to 402*h*.

Figure 19:
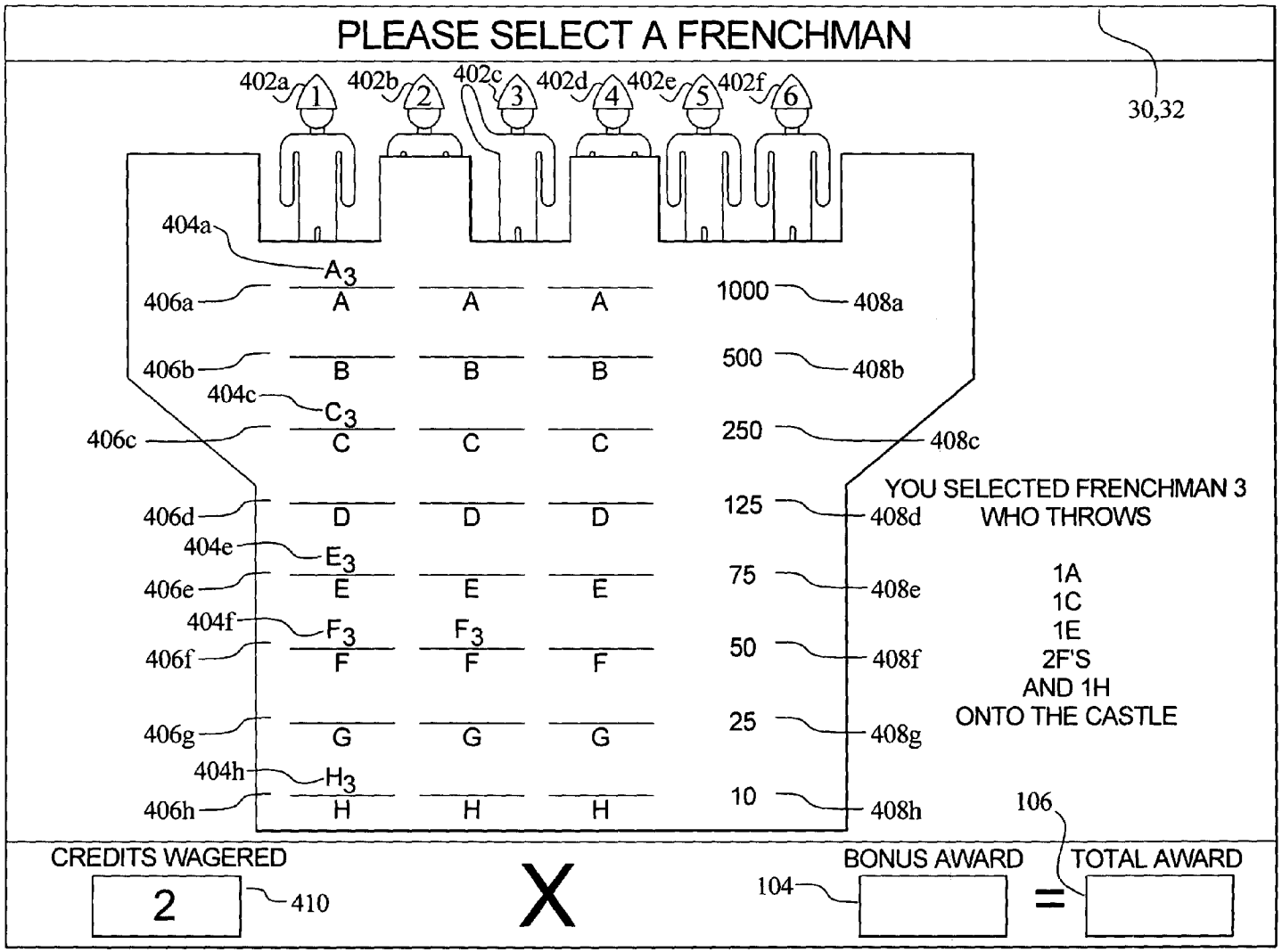
FIG. 19 is a front elevational view of one of the display devices of FIGS. 1A and 1B illustrating a first selection by a player in the example of FIG. 18.

Referring now to FIG. 19, the player selects selection 402*c*, labeled "3". Selection 402*c* is associated with: one "A" Component 404*a*, one "C" Component 404*c*, one "E" Component 404*e*, two "F" Components 404*f*, and one "H" Component 404*h*. The display 30 or 32 displays to the player the positions in each group filled by these components. Two of the three "F's" associated with selection 402*c* have been selected; therefore, only one "F" needs to be in one of the subsequent selections to complete the "F" group 406*f*. The player in a first-to-fill game will likely desire that the next selection not have an associated "F" component 404*f* thereby, precluding the player from receiving a larger outcome associated with one or more of the other groups. In contrast, the player will not be concerned about "prematurely" filling the "F" group 406*f* if the game alternatively, provides a predetermined number of selections, and does not limit the player to the outcome associated with the first filled group.

Figure 20:
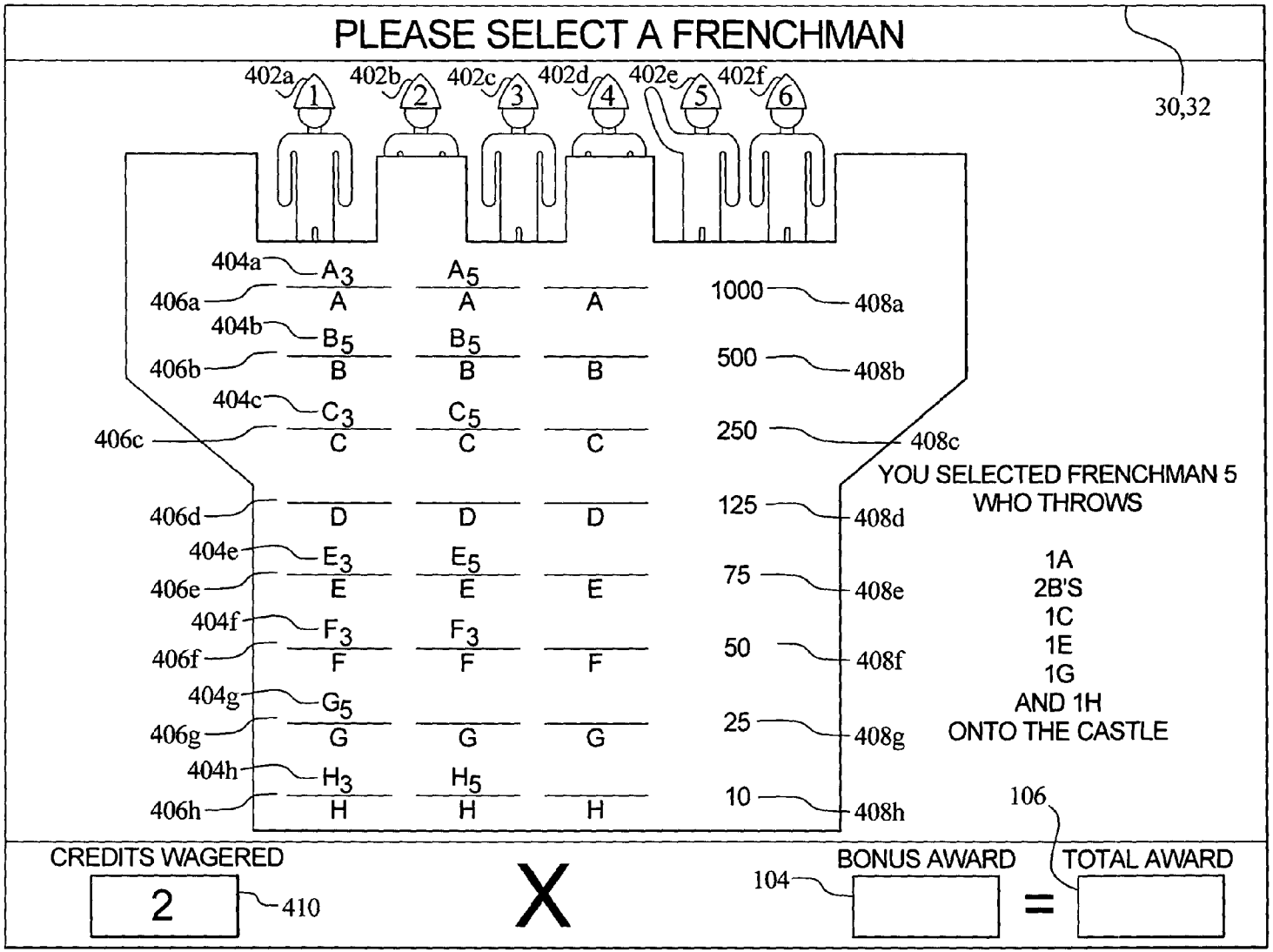
FIG. 20 is a front elevational view of one of the display devices of FIGS. 1A and 1B illustrating a second selection by a player in the example of FIG. 18.

FIG. 20 displays the gaming device after the player has selected selection 402*e* labeled "5". One "A" component 404*a*, two "B" components 404*b*, one "C" component 404*c*, one "E" component 404*e*, one "G" component 404*g*, and one "H" component 404*h* are associated with selection 402*e*. The display reveals to the player the filling of each group by each component of that group associated with selection 402*e* selected by the player. The player is shown that two of the three components in the "A" group 406*a*, "B" group 406*b* and "C" group 406*c* have been provided to the player. The next selection could contain components in either or all of these groups having relatively large outcomes associated therewith. Alternatively, the player in a first-to-fill game is concerned that a group having a relatively small outcome associated with that group may be completed before the other, more valuable groups are completed, thereby, precluding the winning of a larger outcome associated with the other groups.

Figure 21:
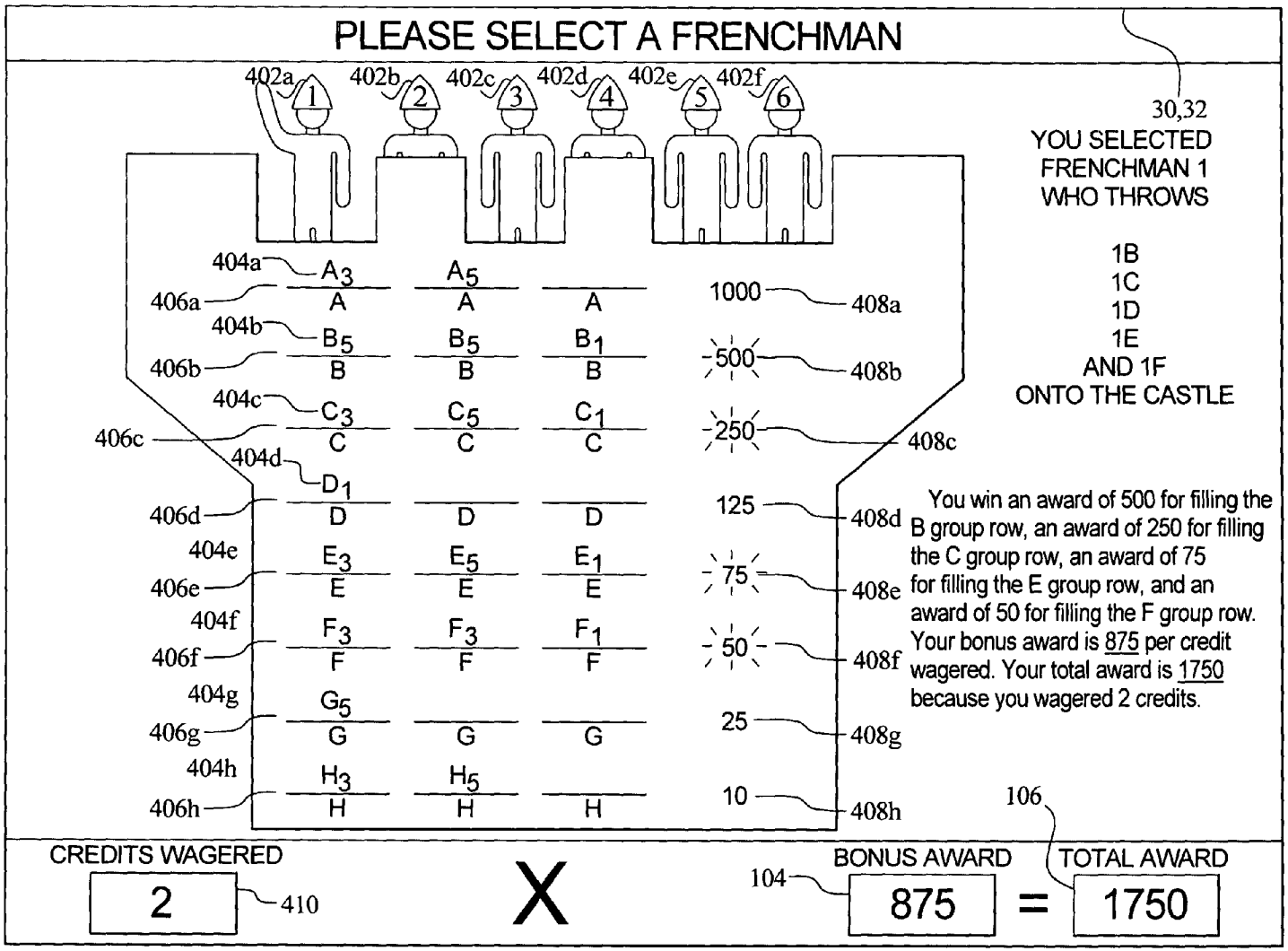
FIG. 21 is a front elevational view of one of the display devices of FIGS. 1A and 1B illustrating a third selection by a player in the example of FIG. 18.

Referring now to FIG. 21, the player has selected selection 402*a*, labeled "1" which includes one "B" component 404*b*, one "C" component 404*c*, one "D" component 404*d*, one "E" component 404*e* and one "F" component 404*f*. FIG. 21 illustrates the display in either the first-to-fill or the three-selection embodiments where the player simultaneously filled the "B" component group 406*b*, "C" component group 406*c*, "E" component group 406*e*, and "F" component 406*f*, thereby, receiving the outcomes 408*b*, 408*c*, 408*e*, and 408*f* associated with the filled groups, respectively. Specifically, the player receives five hundred credits 408*b* for filling the "B" group 406*b*, two hundred fifty credits 408*c* for filling the "C" group 406*c*, seventy-five credits 408*e* for filling the "E" group 406*e* and fifty credits 408*f* for filling the "F" group 406*f*. In an alternative embodiment, the gaming device randomly provides the player one or more of the outcomes associated with the filled or completed groups.

In one embodiment, the credits wagered in the primary game 410 can be multiplied by the outcomes associated with the completed groups to give a total outcome 106 to the player. The display, as in FIGS. 18 to 21, can remind the player of the number of credits wagered in a primary game which can be multiplied by any bonus game outcome to determine a total outcome provided to the player. In the illustrated game, the player has won eight hundred and seventy-five credits 104 per credit wagered 410 in the primary game to give the player a total outcome 106 of one thousand seven hundred fifty credits. In other embodiments, any symbols selected for each group representing a modifier or bonus may be applied to the outcome for that group. In a preferred embodiment, no outcome is provided to the player for groups that remain incomplete or unfilled before the filling of other groups or within the predetermined number of selections.

As an alternative to providing a player an outcome associated with a group that is first to be filled or completed, the gaming device can provide a player a predetermined number of selections in which to complete a group 406. FIG. 22 illustrates the outcomes for a three-selection game wherein the player receives a predetermined number of three selections of six possible selections. The selections can be in any order to provide the player with the same outcome. The table in FIG. 22 illustrates the outcome associated with each combination of selections available to a player in a three-selection game. By incorporating the component distribution among selections illustrated in FIG. 17 and employed in the game example in this description, each outcome of each combination of selections is illustrated in FIG. 22. Whether a particular group of related components will be completed or not is based on a probability 414. The number of completed groups can be determined by multiplying the probability 414 associated with each group of components by the possible combination of selections 402. For the "A" group 406*a*, only one combination fills the group: selection 402*c*, selection 402*e*, and selection 402*f*. Included in these three selections 402*c*, 402*e*, 402*f* are three "A" components 404*a* that fill the "A" group 406*a*. Because there is only one win 416*a* or one combination out of twenty that fills a group and provides an outcome, the player has a five percent probability 414*a* of winning the outcome associated with the "A" group 406*a*. The player, however, has a much higher probability 414*a* of winning an outcome in the "H" group 406*h*. Because there are fourteen wins 416*h* possible out of the twenty combinations of a three-selection game, the player has a seventy percent probability 414*a* of winning an outcome 408*h* associated with an "H" group 406*h*. The implementer of the game can vary the probability 414 that a particular outcome will be provided to the player based on the number of wins 416 possible among the possible combinations of selections or any other suitable method.

FIG. 23 illustrates the difference between a game allowing a predetermined number of selections, —a three-selection game, and a game allowing selections until the first group is completed, —a first-to-fill game. Using one of the combinations of the three-selection game, selection "1" 402*a*, selection "2" 402*b*, and selection "3" 402*c*, an outcome 420 of three hundred and eight-five credits is won in a game using the distribution table of FIG. 17. It can be seen in FIG. 23 that the order of the selections made by a player in a first-to-fill game may determine the amount of the outcome. In the first order of selection where the player selects selection "1" 402*a*, selection "2" 402*b*, and selection "3" 402*c*, the first group to be filled is the "E" group 406*e*. The "E" group 406*c* is filled after only two selections and the gaming provides the player with the outcome 422 of seventy-five credits. Compare this outcome 422 with a three-selection game where the player selected the same three selections 402*a*, 402*b*, 402*c* and won an outcome 420 of three hundred and eighty-five credits. If the player selects selection "1" 402*a* followed by selection "3" 402*c* instead of selection "2" 402*b*, the player will fill the "F" group 406*f* first and the game will end with the player only receiving an outcome 424 of fifty credits instead of seventy-five credits. It should be appreciated that in a first-to-fill game, the player may require more than three selections to fill a group. It is preferable that the player must select at least two selections to fill a group. It should be appreciated that the gaming device provide the player a number of selections earned in a previous game and display said number of selections to the player prior to the start of the subsequent game. Alternatively, the player may be informed at the beginning of the game that the game will end upon filling one of the groups or a particular group with the outcome 408 associated with those groups 406 being provided to the player.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device operable under the control of at least one processor, said gaming device comprising:

at least one input device; and at least one display device, said at least one processor programmed to operate with the at least one input device and the at least one display device, for a single play of a game, to:

(a) before a player selects any of a plurality of individually selectable player-selectable selections, simultaneously display:

(i) a plurality of sets of components, each set including a plurality of components, each component of each set of components displayed at a respective display area separate from each of the components of the other sets of components, and (ii) the plurality of individually selectable player-selectable selections separate from the plurality of sets of components, each selection being associated with a plurality of said components, said plurality of components including at least one, but not all, of the components of at least one of said sets of components, wherein each component of each of the plurality of sets of components is associated with one or more of said selections and a plurality of the selections are associated with a different number of components, (b) thereafter, enable the player to sequentially pick a plurality of the selections in the single play of the game until a predetermined number of the components of at least one of the sets of components is selected, wherein the predetermined number is greater than one, and causing each of the plurality of components of each picked selection to be displayed at the display area of its respective set of components in addition to the set of components before a subsequent selection is picked, wherein for at least one of the player's sequential picks, each of a plurality of selections that are not yet picked by the player in the single play of the game are simultaneously eligible to be picked, and (c) if the predetermined number of the components associated with said set is selected:

(i) determine at least one outcome associated with said set based on the components included in said set, and (ii) display and provide the player the at least one determined outcome associated with said set.

2. The gaming device of claim 1, wherein each of the plurality of sets of components include a predetermined number of components.

3. The gaming device of claim 1, wherein the number of components in one of the sets of components is based on the outcome associated with said set.

4. The gaming device of claim 1, wherein at least one of the components of one of the sets of components is a modifier, said modifier operable to modify the outcome associated with said set.

5. The gaming device of claim 4, wherein the modifier includes a multiplier.

6. The gaming device of claim 1, wherein the number of picks of the selections is predetermined.

7. The gaming device of claim 1, wherein the number of picks of the selections is based on a previous event in the single play of the game.

8. The gaming device of claim 1, wherein the components are randomly associated with the selections.

9. The gaming device of claim 1, wherein at least one of said selections includes components from more than one set of components.

10. The gaming device of claim 1, wherein at least one of the selections includes a plurality of components from the same set of components.

11. The gaming device of claim 1, wherein at least two different components are associated with each selection.

12. The gaming device of claim 1, wherein the number of components of one set of components associated with the selections is based on the outcome associated with said set.

13. The gaming device of claim 1, wherein the number of components of one set of components associated with the selections is based on a probability associated with said set.

14. The gaming device of claim 1, wherein a modifier is associated with at least one of the selections.

15. The gaming device of claim 14, wherein the modifier includes a multiplier.

16. The gaming device of claim 14, wherein the modifier associated with said selection modifies the number of components associated with said selection.

17. The gaming device of claim 1, wherein a modifier is associated with at least one of the components.

18. The gaming device of claim 1, wherein an outcome is associated with each set of components.

19. The gaming device of claim 1, wherein a plurality of outcomes are associated with at least one of the sets of components.

20. The gaming device of claim 19, wherein the outcome provided to said player is randomly selected from the plurality of the outcomes associated with said set of components.

21. The gaming device of claim 1, wherein different outcomes are associated with each of the different sets of components.

22. The gaming device of claim 1, wherein outcomes are randomly associated with the sets of components.

23. The gaming device of claim 1, wherein at least one of the outcomes associated with at least one of the sets of components is an award.

24. The gaming device of claim 23, wherein the player is provided the outcome associated with the last set of components selected.

25. The gaming device of claim 1, wherein the single play of the game ends when all of the components of at least one set of components are selected.

26. The gaming device of claim 1, wherein the single play of the game ends when all of the components of multiple sets of components are selected.

27. The gaming device of claim 1, wherein the single play of the game ends when the player has made a predetermined number of selections.

28. The gaming device of claim 1, which is operated through a data network.

29. The gaming device of claim 28, wherein the data network is selected from the group consisting of a playing station network, a local area network, a wide area network and an internet.

30. A gaming device operable under control of at least one processor, said gaming device comprising:

at lease one input device; and at least one display device, said at least one processor programmed to operate with the input device and the display device, for a single play of a game, to:

(a) before a player selects any of a plurality of individually selectable player-selectable selections, simultaneously display:

(i) a plurality of sets of components, each set of components including a plurality of components, each component of each set of components displayed at a respective display area separate from each of the components of the other sets of components, and (ii) the plurality of individually selectable player-selectable selections separate from the plurality of sets of components, each selection being associated with a plurality of said components, said plurality of components including at least one, but not all, of the components of at least one of the sets of components, wherein each component of a plurality of the sets of components is associated with one or more of said selections and a plurality of the selections are associated with a different number of components, (b) thereafter, enable the player to pick a plurality of the selections in the single play of the game until a predetermined number of the components of at least one of the sets of components is selected, wherein the predetermined number is greater than one, wherein the plurality of picked selections are picked sequentially, and causing each of the plurality of components of each picked selection to be displayed at the display area of its respective set of components in addition to the set of components before a subsequent selection is picked, wherein for at least one of the player's sequential picks, each of a plurality of selections that are not yet picked by the player in the single play of the game are simultaneously eligible to be picked, and (c) if at least one predetermined component of said set is selected:

(i) determine at least one outcome associated with said set based on the components included in said set, and (ii) display and provide to the player the determined outcome associated with said set.

31. The gaming device of claim 30, wherein each of the plurality of sets of components include a predetermined number of components.

32. The gaming device of claim 30, wherein the number of components in a set of components is based on the outcome associated with said set.

33. The gaming device of claim 30, wherein at least one of the components of one of the sets is a modifier, said modifier operable to modify the outcome associated with said set.

34. The gaming device of claim 33, wherein the modifier includes a multiplier.

35. The gaming device of claim 30, wherein the number of picks of the selections is predetermined.

36. The gaming device of claim 30, wherein the number of picks of the selections is based on a previous event in the single play of the game.

37. The gaming device of claim 30, wherein the components are randomly associated with the selections.

38. The gaming device of claim 30, wherein at least one of said selections includes components from more than one set of components.

39. The gaming device of claim 30, wherein at least one of the selections includes a plurality of components from the same set of components.

40. The gaming device of claim 30, wherein at least two different components are associated with each selection.

41. The gaming device of claim 30, wherein the number of components of one set associated with the selections is based on the outcome associated with said set.

42. The gaming device of claim 30, wherein the number of components of one set of components associated with the selections is based on a probability associated with said set.

43. The gaming device of claim 30, wherein a modifier is associated with at least one of the selections.

44. The gaming device of claim 43, wherein the modifier includes a multiplier.

45. The gaming device of claim 43, wherein the modifier associated with one of the selections modifies the number of components associated with said selection.

46. The gaming device of claim 30, wherein a modifier is associated with at least one of the components.

47. The gaming device of claim 30, wherein an outcome is associated with each set of components.

48. The gaming device of claim 30, wherein a plurality of outcomes are associated with at least one of the sets of components.

49. The gaming device of claim 48, wherein the outcome provided to said player is randomly selected from the plurality of the outcomes associated with said set of components.

50. The gaming device of claim 30, wherein different outcomes are associated with each of the different sets of components.

51. The gaming device of claim 30, wherein outcomes are randomly associated with the sets of components.

52. The gaming device of claim 30, wherein at least one of the outcomes associated with at least one of the sets of components is an award.

53. The gaming device of claim 52, wherein the player is provided the outcome associated with the last set of components selected.

54. The gaming device of claim 30, wherein the single play of the game ends when all of the components of at least one set of components are selected.

55. The gaming device of claim 30, wherein the single play of the game ends when all of the components of multiple sets of components are selected.

56. The gaming device of claim 30, wherein the single play of the game ends when the player has made a predetermined number of selections.

57. The gaming device of claim 30, which is operated through a data network.

58. The gaming device of claim 57, wherein the data network is selected from the group consisting of a playing station network, a local area network, a wide area network and an internet.

59. A gaming device operable under the control of at least one processor, said gaming device comprising:

at least one input device; and at least one display device, said at least one processor programmed to operate with the input device and the display device, for a single play of a game, to:

(a) before a player selects any of a plurality of individually selectable selections, simultaneously display:

(i) the plurality of individually selectable selections, and (ii) a plurality of different sets of components, each set of components including a predetermined number of components, each component of each set of components displayed at a respective display area separate from each of the components of the other sets of components and the plurality of individually selectable selections, wherein a plurality of the selections are associated with a different number of said components, and (b) thereafter, display and provide a plurality of awards associated with the sets of components, said awards including at least two of the different awards associated with at least two different sets of components, wherein the number of components of each of said sets of components associated with said selections is based on the awards associated with each of said sets of components, wherein if the predetermined number of the components of one of the sets of components is selected, said award associated with said set is provided to the player, wherein for the single play of the game the player individually selects a first individually selectable selection of the individually selectable selections prior to selecting a second individually selectable selection of the individually selectable selections, and wherein each of the components associated with the first individually selectable selection is displayed at the symbol display area of its respective set of components prior to the player selecting the second individually selectable selection, wherein the second individually selectable selection is eligible for selection by the player when the first individually selectable selection is selected.

60. The gaming device of claim 59, wherein more than one component of one set of components is associated with at least one selection.

61. The gaming device of claim 59, wherein the number of components of one set of components associated with the selections is greater than the predetermined number of components which must be selected for the player to receive the award associated with said set of components.

62. The gaming device of claim 59, wherein the single play of the game ends when a predetermined number of selections have been made by the player.

63. The gaming device of claim 59, wherein the single play of the game ends when the predetermined number of components of at least one set of components have been selected.

64. A method of operating a gaming device, said method comprising, for a single play of a game:

causing a processor to operate with a device and an input device to:

(a) before enabling a player to select any of a plurality of individually selectable player-selectable selections, simultaneously display:

(i) a plurality of sets of components, wherein each of said sets includes a predetermined number of components, each component of each set of components displayed at a respective display area separate from each of the components of the other sets of components, and (ii) the plurality of individually selectable player-selectable selections separate from the plurality of sets of components, each selection being associated with a plurality of said components, said plurality of components including at least one, but not all, of the components of at least one of the sets of components;

(b) associate at least one component of at least one of a plurality of the sets of components with each of the selections, wherein a plurality of the selections are associated with a different number of components;

(c) associate at least one outcome with at least one of said sets; and (d) enable the player to sequentially select a plurality of said selections in the single play of the game, and causing each of the components associated with the selected selections to be displayed at the display area of its respective set of components in addition to the set of components prior to subsequent selections being made, until a predetermined number of the components of at least one of the sets of components is selected wherein the predetermined number is greater than one, wherein for at least one of the player's sequential selections each of a plurality of selections that are not yet selected by the player in the single play of the game are simultaneously eligible to be selected; and causing the processor to operate with the display device to:

if the predetermined number of the components associated with said set of components is selected:

(i) determine at least one outcome associated with said set of components based on the components included in said set of components, and (ii) display at least one of the determined outcomes associated with said set of components.

65. The method of claim 64, wherein the number of components of one set of components associated with the selections is based on the outcome associated with said set of components.

66. The method of claim 64, wherein the number of components of one set of components associated with the selections is based on a probability associated with said set of components.

67. The method of claim 64, wherein all of the components associated with each selection are masked from the player until the selection is picked.

68. The method of claim 64, wherein selecting a plurality of said selections includes revealing the components associated with the picked selections.

69. The method of claim 64, wherein the outcome provided to the player is the outcome associated with the set of components having the predetermined number of components of said set of components selected.

70. The method of claim 64, wherein providing a player at least one of the outcomes associated with at least one of said sets of components includes randomly selecting one of a plurality of outcomes associated with said set of components.

71. The method of claim 64, which includes ending the single play of the game when a predetermined number of selections have been made.

72. The method of claim 64, which includes ending the single play of the game when the predetermined number of components of at least one of the sets of components have been selected.

73. The method of claim 64, which includes operating said gaming device through a data network.

74. The method of claim 73, wherein the data network is selected from the group consisting of a playing station network, a local area network, a wide area network and an internet.

75. A method of operating a gaming device, said method comprising, for a single play of a game:

causing a processor to operate with a display device and an input device to:

(a) before enabling a player to select any of a plurality of individually selectable player-selectable selections, simultaneously display;

(i) each component of each of a plurality of sets of components at a different respective display area, wherein each set includes a predetermined number of components, and wherein the predetermined number is greater than one, and (ii) the plurality of individually selectable player-selectable selections separate from the plurality of sets of components, each selection being associated with a plurality of said components, said plurality of components including at least one, but not all, of the components of at least one of the sets of components, wherein a plurality of the selections are associated with a different number of components;

(b) associate at least one outcome with at least one of said sets of components;

(c) enable the player to sequentially select a predetermined number of said selections in the single play of the game, wherein for at least one of the player's sequential selections each of a plurality of selections that are not yet selected by the player in the single play of the game are simultaneously eligible to be selected; and (d) reveal each of the components associated with each selected selection and display it at the symbol display area of its respective set of components in addition to the set of components prior to a subsequent selection being made; and causing the processor to operate with the display device to:

if the predetermined number of the components associated with said set of components is selected:

(i) determine at least one outcome associated with said set of components based on the components included in said set of components, and (ii) provide the player the determined outcome.

76. The method of claim 75, which includes ending the single play of the game when a predetermined number of selections have been made.

77. The method of claim 75, which includes operating said gaming device through a data network.

78. The method of claim 77, wherein the data network is selected from the group consisting of a playing station network, a local area network, a wide area network and an internet.

79. A method of operating a gaming device, said method comprising, for a single play of a game:

causing a processor to operate with a display device and an input device to:

(a) before enabling a player to select any of a plurality of individually selectable selections, simultaneously display:

(i) each component of each of a plurality of sets of components at a different respective display area, wherein at least one outcome is associated with at least one of said sets of components, and (ii) the plurality of individually selectable selections separate from the plurality of sets of components, wherein each selection is associated with at least one of said components and wherein each selection includes less than the predetermined number of components of each of the sets of components and a plurality of the selections are associated with a different number of components; and (b) enable the player to sequentially select a plurality of said selections in the single play of the game until a predetermined number of components of at least one of said sets of components is selected, causing each of the components associated with each of the selected selections to be displayed at the display area of its respective set of components in addition to the set of components prior to a subsequent selection being selected, wherein for at least one of the player's sequential selections each of a plurality of selections that are not yet selected by the player in the single play of the game are simultaneously eligible to be selected; and causing the processor to operate with the display device to:

if the predetermined number of the components associated with said set of components is selected:

(i) determine at least one outcome associated with said set of components based on the components included in said set of components, and (ii) provide the player the determined outcome.

80. The method of claim 79, which includes ending the single play of the game when a predetermined number of components of at least one of said sets of components is selected.

81. The method of claim 79, which includes operating said gaming device through a data network.

82. The method of claim 81, wherein the data network is selected from the group consisting of a playing station network, a local area network, a wide area network and an internet.

83. A method of operating a gaming device, said method comprising, for a single play of a game:

causing a processor to operate with a display device and an input device to:

(a) associate a plurality of components with each of a plurality of sets of components;

(b) display each of the components of each of the plurality of sets of components at a different respective display area simultaneous with a plurality of masked selections before a player selects any of the masked selections;

(c) associate an outcome with at least one of said sets of components;

(d) associate the components of each set of components with a plurality of individually selectable masked selections, wherein each selection is associated with a plurality of said components, said plurality of components including at least one, but not all, of the components of at least one of the sets of components, wherein a plurality of the selections are associated with a different number of components, and wherein the plurality of the masked selections are displayed separate from the plurality of sets of components; and (e) enable the player to select the plurality of selections in the single play of the game, causing each of the components associated with each selected selection to be displayed at the display area of its respective set of components in addition to the set of components before the player is enabled to select a subsequent selection, until a predetermined number of the components of at least one of the sets of components is selected, wherein the predetermined number is greater than one, wherein for at least one of the player's selections each of a plurality of selections that are not yet selected by the player in the single play of the game are simultaneously eligible to be selected; and causing the processor to operate with the display device to: if the predetermined number of the components associated with said set of components is selected:

(i) determine at least one outcome associated with said set of components based on the components included in said set of components, and (ii) provide the player the determined outcome.

84. The method of claim 83, which includes associating at least one predetermined component of a set of components with at least one of said selections based on the outcome associated with said set of components.

85. The method of claim 83, which includes operating said gaming device through a data network.

86. The method of claim 85, wherein the data network is selected from the group consisting of a playing station network, a local area network, a wide area network and an internet.

* * * * *

UNITED STATES PATENT AND TRADEMARK OFFICE

CERTIFICATE OF CORRECTION

PATENT NO. : 7,867,074 B2
APPLICATION NO. : 10/652457
DATED : January 11, 2011
INVENTOR(S) : Gerrard et al.

It is certified that error appears in the above-identified patent and that said Letters Patent is hereby corrected as shown below:

In the Claims:

In Claim 30, column 21, line 28, replace “the input device” with --the at least one input device--.

In Claim 30, column 21, line 29, replace “the display device” with --the at least one display device--.

In Claim 59, column 23, line 18, replace “the input device” with --the at least one input device--.

In Claim 59, column 23, lines 18 to 19, replace “the display device” with --the at least one display device--.

In Claim 59, column 23, line 35, replace “two of the different awards” with --two different awards--.

In Claim 64, column 24, line 45, before “if” insert --(e)--.

In Claim 75, column 25, line 57, before “if” insert --(e)--.

In Claim 79, column 26, line 38, before “if” insert --(c)--.

In Claim 83, column 27, line 2, replace “a plurality” with --the plurality--.

In Claim 83, column 28, line 4, before “if” insert --(f)--.

Signed and Sealed this
Eighth Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,867,074 B2
APPLICATION NO. : 10/652457
DATED : January 11, 2011
INVENTOR(S) : Gerrard et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 946 days.

Signed and Sealed this
Thirty-first Day of May, 2011

David J. Kappos

David J. Kappos
*Director of the United States Patent and Trademark Office*